US007890058B2

(12) United States Patent
Hazama

(10) Patent No.: US 7,890,058 B2
(45) Date of Patent: Feb. 15, 2011

(54) GAME MACHINE AND INFORMATION COMMUNICATION SYSTEM USING DATA CARRIER

(75) Inventor: Katsuki Hazama, Hsin-Chu (TW)

(73) Assignee: United Microelectronics Corporation, Science Based Industrial Park, Hsin Chu (TW)

( * ) Notice: Subject to any disclaimer, the term of this patent is extended or adjusted under 35 U.S.C. 154(b) by 148 days.

(21) Appl. No.: 12/192,124

(22) Filed: Aug. 15, 2008

(65) Prior Publication Data

US 2008/0306644 A1 Dec. 11, 2008

Related U.S. Application Data

(62) Division of application No. 10/904,170, filed on Oct. 27, 2004, now abandoned, which is a division of application No. 09/817,123, filed on Mar. 27, 2001, which is a division of application No. 09/060,106, filed on Apr. 15, 1998, now Pat. No. 6,234,902.

(30) Foreign Application Priority Data

| | | |
|---|---|---|
| Apr. 16, 1997 | (JP) | 9-114413 |
| Dec. 16, 1997 | (JP) | 9-363693 |
| Feb. 19, 1998 | (JP) | 10-036889 |

(51) Int. Cl.

| | |
|---|---|
| ***H04B 7/00*** | (2006.01) |
| ***H04B 1/00*** | (2006.01) |
| ***B60R 25/00*** | (2006.01) |
| ***G08B 13/00*** | (2006.01) |
| ***G08B 23/00*** | (2006.01) |

(52) U.S. Cl. ..... 455/41.2; 455/68; 455/70; 340/5.7; 340/500; 340/550

(58) Field of Classification Search ..... 455/41.1, 455/41.2, 68, 70, 556.1; 340/5.62, 5.7, 10.1, 340/10.3, 10.4, 500, 550, 564
See application file for complete search history.

(56) References Cited

U.S. PATENT DOCUMENTS

| | | | | |
|---|---|---|---|---|
| 4,354,189 | A * | 10/1982 | Lemelson | 340/5.61 |
| 5,831,533 | A * | 11/1998 | Kanno | 340/5.64 |
| 5,853,327 | A | 12/1998 | Gilboa | |
| 5,877,969 | A * | 3/1999 | Gerber | 705/13 |
| 5,900,815 | A * | 5/1999 | Story | 340/548 |
| 5,949,349 | A * | 9/1999 | Farris et al. | 340/5.26 |
| 6,014,088 | A | 1/2000 | Van Santbrink | |

(Continued)

FOREIGN PATENT DOCUMENTS

| | | |
|---|---|---|
| GB | 2 103 943 A | 3/1983 |

(Continued)

*Primary Examiner*—Andrew Wendell
(74) *Attorney, Agent, or Firm*—Winston Hsu; Scott Margo

(57) ABSTRACT

A game apparatus includes an apparatus body; and a plurality of small playing members each having a data carrier for transmitting driving electric power and performing mutual communications with the apparatus body. The number of points is added by the apparatus body when a change is given from the outside to an arbitrarily selected small playing member among the plurality of small playing members under a predetermined condition. In another aspect, an automated traveling control system for executing a process corresponding to a kind of a carrier object traveling by a gate is disclosed.

1 Claim, 19 Drawing Sheets

U.S. PATENT DOCUMENTS

| | | | | |
|---|---|---|---|---|
| 6,064,316 | A * | 5/2000 | Glick et al. | 340/5.65 |
| 6,218,956 | B1 * | 4/2001 | Davis et al. | 340/5.2 |
| 6,812,824 | B1 * | 11/2004 | Goldinger et al. | 340/10.1 |
| 2001/0014622 | A1 * | 8/2001 | Hazama | 463/36 |
| 2004/0085185 | A1 * | 5/2004 | Waggamon et al. | 340/5.7 |
| 2005/0054406 | A1 * | 3/2005 | Hazama | 463/9 |

FOREIGN PATENT DOCUMENTS

| | | |
|---|---|---|
| JP | S58105771 A | 6/1983 |
| JP | 05-151428 | 6/1993 |
| JP | 05-177056 | 7/1993 |
| JP | 07-182357 | 7/1995 |
| JP | H10179930 | 7/1998 |

* cited by examiner

GAME MACHINE AND INFORMATION COMMUNICATION SYSTEM USING DATA CARRIER

CROSS REFERENCE TO RELATED APPLICATIONS

This Application is a Division of application Ser. No. 10/904,170 filed on Oct. 27, 2004, which is a Division of application Ser. No. 09/817,123 filed on Mar. 27, 2001, which is a Division of application Ser. No. 09/060,106 filed on Apr. 15, 1998. Application Ser. No. 09/060,106 claims priority to Japanese Applications 9-114413 filed on Apr. 16, 1997; 9-363693 filed on Dec. 16, 1997; and 10-036889 filed on Feb. 19, 1998. The entire contents of each of these applications are incorporated herein by reference.

BACKGROUND OF THE INVENTION

1. Field of the Invention

The present invention relates to a data carrier, a game machine using the data carrier, an information communication method, an information communication system using the data carrier, automated traveling control system and storing medium, and more particularly, to a non-contact type data carrier, and above-mentioned various application using the non-contact type data carrier.

2. Description of the Prior Art

Cards are known as devices for transmitting various items of information, and particularly a magnetic card having magnetic stripes is widely used.

There is utilized such a magnetic card formed with two magnetic stripes and incorporating two sets of functions corresponding to the two magnetic stripes. This is intended to provided the single magnetic card with the two sets of functions by differentiating the magnetic stripes read by a card reader with a change in inserting direction into the card reader. The above-mentioned two sets of functions may include an application of a variety of functions. For example, the single magnetic card can serve as a bank deposit card and a cashing card.

Thus, the magnetic card can be provided with the plurality of functions and has a storage capacity as small as several tens bytes, and there must be a limit in terms of quantity of data storable therein. Such being the case, there are proposed IC cards having a large storage capacity and incorporating the two sets of functions in, e.g., Japanese Patent Application Laid-Open Publication Nos. 3-142299 (1991), 3-142293 (1991), 1-304998 (1989), 4-355190 (1992), 4-199394 (1992) and 5-342424 (1993).

The non-contact type IC card is high in its manufacturing cost, and hence the cost is reduced generally by a repetitive use for a long period of time. The conventional IC cards proposed in the above Publications are of a contact type and therefore have a problem of being poor in terms of durability and disadvantageous in the number of usable times. To obviate this problem, it is considered that the non-contact type IC card is provided with a plurality of functions.

The IC card for mutually transmitting information with respect to the outside in a non-contact manner is also referred to as a non-contact ID tag, an RF (Radio Frequency Identification)-ID tag, a data tag and a non-contact type data carrier, etc. In the specification of the present invention which follows, however, a most general term "non-contact data carrier" shall be used in principle instead of the non-contact IC.

The non-contact type data carrier generates a DC internal power supply voltage by rectifying an alternate current generated by an electromagnetic induction from radio waves transmitted from the outside, and recognizes that the data carrier itself is called from a host device and then responds thereto.

For instance, as shown in FIG. 1, in a non-contact type data carrier system 800, an inquiry machine 802 is fixedly disposed, and a responder (tag) 801*a* is fitted to a moving body 801. The inquiry machine 802 transmits an inquiry signal radio wave (RF signal) generated by a transmitter/receiver 802*b* through an antenna 802*a*. The responder 801*a* entering a detectable range of the inquiry signal radio waves transmitted by the inquiry machine 802 obtains electric power by receiving the radio waves, and transmits information on an identification (ID) code stored inside as a response signal. The inquiry machine 802 receives this response signal through the antenna 802*a*, and an identification circuit 802*c* decodes the response signal and transmits the necessary information to a host computer 803. Then, the host computer 803 executes a variety of control processes by use of the information given from the inquiry machine 802.

The data carrier described above does not require a power supply such as a battery etc. and is, because of its being of the non-contact type, applied in a variety of fields such as a parking management system, an In-and-out management system, a domestic animal management system, a factory automation (FA) management system, and an automated ticket examining system etc.

An apparatus termed a "Tag Retrieving Apparatus" is disclosed in, e.g., Japanese Patent Application Laid-Open Publication No. 7-182357, wherein a plurality of files are respectively provided with tags (data carriers), and the file information can be transmitted and received highly efficiently by a radio transmission.

Further, Japanese Patent Application Laid-Open Publication No. 5-151428 discloses such a contrivance that the cards in a leisure facilities are provided with tags, whereby the users in a skiing ground and an amusement park can be easily managed.

On the other hand, there have hither to existed various kinds of on-board games such as a card game, chess and an Othello™ game etc, and a variety of proposals about how to collect the game information have been made. For instance, Japanese Patent Application Laid-Open Publication No. 5-177056 discloses a "Dice Point Reading System", wherein the tag is embedded in the vicinity of the surface of each facet of the dice, thereby making it feasible to simultaneously read the points of a plurality of dices.

The on-board game like the chess and the Othello™ game, however, is played by moving a plurality of pieces on the game board. In the prior art, however, it is impossible to automatically record and control existing positions of the respective pieces on the game board with an advancement in the game.

For such an automated recording, there is proposed a contrivance in which the underside of the piece is formed with a protrusions and grooves different corresponding to the types of the pieces in order to distinguish between the pieces, and an identifying mechanism for identifying based on the grooves and the protrusions on the board surface is provided. This identifying mechanism, however, spoils an external appearance and a sense of touching, and becomes, because of being complicated and requiring a troublesome works, expensive. Further, this identifying mechanism uses a mechanical detection and is therefore insufficient in terms of a judging accuracy.

Moreover, the prior art game apparatus is, if a reading personnel and a referee etc. are needed in addition to the players, neither capable of recording and controlling the advancement in the game nor capable of freely setting the rules of the game. As a result, the players can play the game within only such a range that the number of players and rules for performing the game are predetermined. Furthermore, the price also becomes higher with the more complicated configuration of the game apparatus.

Moreover, there increase the applications of the non-contact type data carrier in the field of the data transmission except for the games. A quantity of the data to be dealt with is, however, limited in the prior art, and there is also a limit in terms of a method of transmitting and receiving the data.

Additionally, in the case of the non-contact type data carrier of the IC card type, the communications with the card reader are performed through radio waves, and hence the card reader is difficult to accurately recognize a positional relationship with respect to the surface and the underside of the IC card. Therefore it is difficult to incorporate a plurality of functions into the non-contact type IC card, corresponding to states of the surface and the underside of the card body.

SUMMARY OF THE INVENTION

It is a first object of the present invention to provide a data carrier enabling a card reader to accurately recognize a positional relationship for a judgment about a surface and an underside, and individually independently having a first function corresponding to the surface of the card and a second function corresponding to the underside thereof.

It is a second object of the present invention to provide a data carrier capable of dealing with a large quantity of information and incorporating more functions.

It is a third object of the present invention to provide a game apparatus capable of efficiently recording and controlling an advancement in a game.

It is a fourth object of the present invention to provide an information communication method, an information communication system and an automated traveling control system using a data carrier capable of dealing with a large quantity of information and efficiently transmitting data.

It is a fifth object of the present invention to provide a stored medium which stores processing steps (code means) for executing the above-mentioned game apparatus, information communication system and traveling control system in a form readable by a computer.

According to the first aspect of the present invention, there is provided a game apparatus comprising: a body including a first control device for transmitting and receiving data required in terms of a advancement in a game; and game parts each including a data carrier having a second control device for transmitting and receiving driving electric power as well as for mutually transferring the data between said game part and said body, and a multi-value memory stored with information containing the identifying information, a game apparatus comprising: a body including a first control device for transmitting and receiving data required in terms of a advancement in a game; and game parts each including a data carrier having a second control device for transmitting and receiving driving electric power as well as for mutually transferring the data between said game part and said body, and a multi-value memory stored with information containing the identifying information, said multi-value memory being provided a plurality of multi-value cells, each of said cells being capable of storing one from states which are taken by three or more predetermined values as storing information.

According to the second aspect of the present invention, there is provided a game apparatus comprising: an apparatus body having apparatus-side control means for controlling a whole apparatus; and a plurality of pieces, each incorporating a data carrier for transmitting driving electric power and performing mutual communications in non-contact with said apparatus body, to which different values are allocated, wherein a win and a defeat are determined based on the values of the pieces selected by opponents among said plurality of pieces.

According to the third aspect of the present invention, there is provided a game apparatus comprising: an apparatus body; and a plurality of small playing members each having a data carrier for transmitting driving electric power and performing mutual communications with said apparatus body, wherein the number of points is added by said apparatus body when a change is given from the outside to an arbitrarily selected small playing member among said plurality of small playing members under a predetermined condition According to the fourth aspect of the present invention, there is provided a data carrier comprising: an information receiving unit for receiving information from the outside; a multi-value memory stored with data necessary for processing and/or with a program; and a control unit for executing a process on the basis of the information received by said information receiving unit and a storage content of said multi-value memory, a game apparatus comprising: a body including a first control device for transmitting and receiving data required in terms of a advancement in a game; and game parts each including a data carrier having a second control device for transmitting and receiving driving electric power as well as for mutually transferring the data between said game part and said body, and a multi-value memory stored with information containing the identifying information, said multi-value memory being provided a plurality of multi-value cells, each of said cells being capable of storing one from states which are taken by three or more predetermined values as storing information.

According to the fifth aspect of the present invention, there is provided an information communication method of transmitting and receiving information between a reader and a non-contact type data carrier in a non-contact manner, said method comprising: a first step of transmitting a radio wave from said reader; a second step of receiving the radio wave transmitted from said reader through a coil and generating operating electric power of said non-contact type data carrier; a third step of detecting that said operating power generating means generates a predetermined quantity of electric power and notifying said reader of this detection; a fourth step of interrupting the transmission of the radio wave from said reader when notified of the effect that the predetermined quantity of electric power is generated; a fifth step of resuming the transmission of the radio wave when a predetermined time elapses since the transmission of the radio wave was interrupted; a sixth step of making a judgment about the surface and the underside of a card body on the basis of a direction of an electric current induced in said coil when the transmission of the radio wave resumes; a seventh step of operating a first function provided in said data carrier when judging in said sixth step that the surface of said card body is set in a required direction; and an eighth step of operating a second function provided ins aid data carrier when judging in said sixth step that the underside of said card body is set in the appropriate direction.

According to the sixth aspect of the present invention, there is provided an information communication system comprising: a data carrier having an information receiving unit for receiving information from the outside, a multi-value memory and a control unit for executing a process for the outside on the basis of the information received by said information receiving unit and a storage content of said multi-value memory; and a reader for executing a process by transmitting necessary information to said data carrier and receiving the radio wave transmitted from said data carrier, a game apparatus comprising: a body including a first control device for transmitting and receiving data required in terms of a advancement in a game; and game parts each including a data carrier having a second control device for transmitting and receiving driving electric power as well as for mutually transferring the data between said game part and said body, and a multi-value memory stored with information containing the identifying information, said multi-value memory being provided a plurality of multi-value cells, each of said cells being capable of storing one from states which are taken by three or more predetermined values as storing information.

According to the ninth aspect of the present invention, there is provided an automated traveling control system for executing a process corresponding to a kind of a carrier object traveling by a gate, comprising: first and second gates; a carrier object traveling by said first and second gates and mounted with an inquiry machine for transmitting a radio wave containing information; a partition wall for partitioning said first and second gate from each other; and a non-contact type data carrier embedded into said partition wall and including a control unit for detecting which side of said first or second gate by receiving the incoming radio wave transmitted from said inquiry machine and executing an opening/closing process of said gate at least on the relevant side depending on any one of said first and second gate sides According to the seventh aspect of the present invention, there is provided an automated traveling control system for executing a process corresponding to a kind of a carrier object traveling by a gate, comprising: first and second gates; a carrier object traveling by said first and second gates and mounted with an inquiry machine for transmitting a radio wave containing information; a partition wall for partitioning said first and second gate from each other; and a non-contact type data carrier embedded into said partition wall and including a control unit for detecting which side of said first or second gate by receiving the incoming radio wave transmitted from said inquiry machine and executing an opening/closing process of said gate at least on the relevant side depending on any one of said first and second gate sides.

According to the eighth aspect of the present invention, there is provided a readable medium stored with a program code for making a computer transmit and receive information between a data carrier reader and a non-contact type data carrier in a non-contact manner, said readable medium being stored with: first code means for executing a first step of transmitting a radio wave from said data carrier reader; second code means for executing a second step of receiving the radio wave transmitted from said data carrier reader through a coil and generating operating electric power of said non-contact type data carrier; third code means for executing a third step of detecting that said operating power generating means generates a predetermined quantity of electric power, and notifying said data carrier reader of this detection; fourth code means for executing a fourth step of interrupting the transmission of the radio wave from said data carrier reader when notified of the effect that the predetermined quantity of electric power is generated; fifth code means for executing a fifth step of resuming the transmission of the radio wave when a predetermined time elapses since the transmission of the radio wave was interrupted; sixth code means of executing a sixth step of making a judgment about the surface and the underside of said data carrier on the basis of a direction of an electric current induced in said coil when the transmission of the radio wave resumes; seventh code means for executing a seventh step of operating a first function provided in said data carrier when judging in said sixth step that the surface of said data carrier body is set in a required direction; and eighth code means for executing an eighth step of operating a second function provided in said data carrier when judging in said sixth step that the underside of said data carrier is set in the appropriate direction.

According to the ninth aspect of the present invention, there is provided a data carrier comprising: an antenna for receiving a radio wave; information communicating means for receiving radio wave information from the outside through said antenna, obtaining necessary electric power and information by electromagnetic induction, and transmitting a result of processing; a multi-value memory having a multi-value memory cell which has a control gate and a charge storage layer for taking at least three storage statuses and which stores one of the at least three storage statuses; and a control unit for executing a process with respect to the outside on the basis of the information received by said information communicating means and a storage content of said multi-value memory.

According to the tenth aspect of the present invention, there is provided a data carrier comprising: generating means for operating electric power by receiving a radio wave transmitted from an outside reading machine through a coil; notifying means for notifying said reading machine of detecting that said generating means generates a predetermined quantity of electric power; judging means for making, when a transmission of the radio wave from the reading machine is interrupted and thereafter resumes after said notifying means has given a notification, a judgment about the surface and underside of a card body on the basis of a direction of an electric current induced in said coil; first function means operating when said judging means judges that the surface of the card body is set in an appropriate direction; and second function means operating when said judging means judges that the underside of the card body is set in the appropriate direction.

These and other objectives of the present invention will no doubt become obvious to those of ordinary skill in the art after reading the following detailed description of the preferred embodiment that is illustrated in the various figures and drawings.

DETAILED DESCRIPTION

A certain number of embodiments of the present invention will hereinafter be discussed with reference to the accompanying drawings.

First Embodiment

Figure 1:
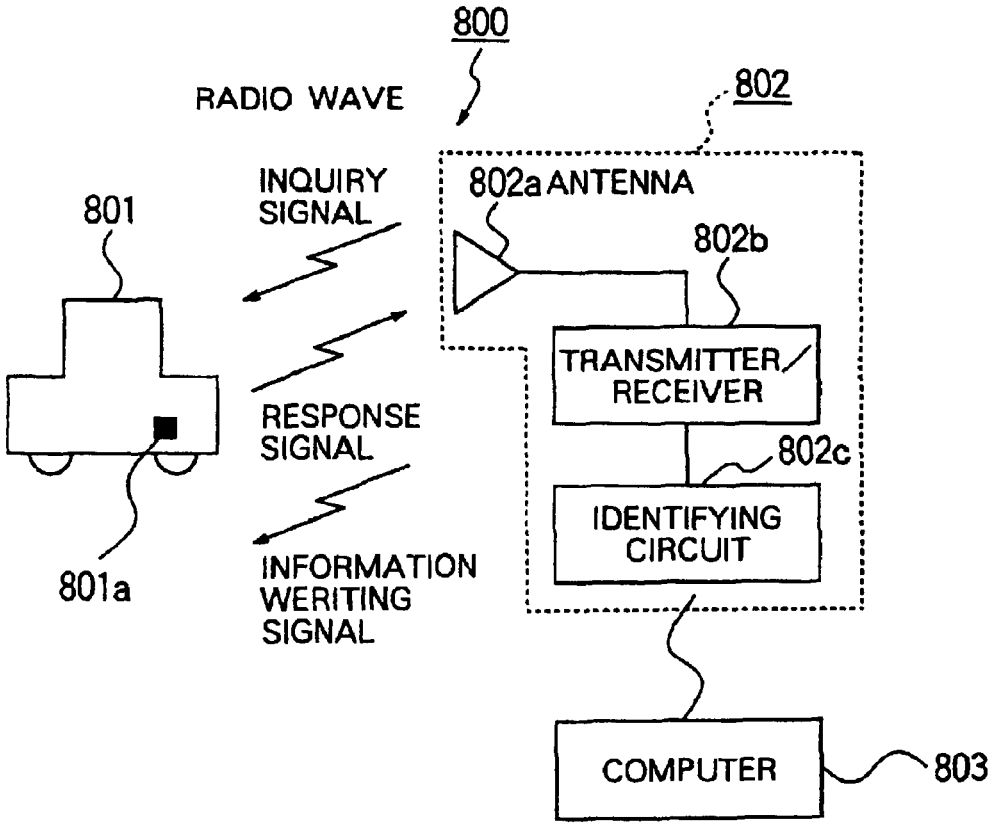
FIG. 1 PRIOR ART
FIG. 1 is a block diagram schematically showing a construction of an information collecting system using a conventional non-contact type IC card.
Figure 2:
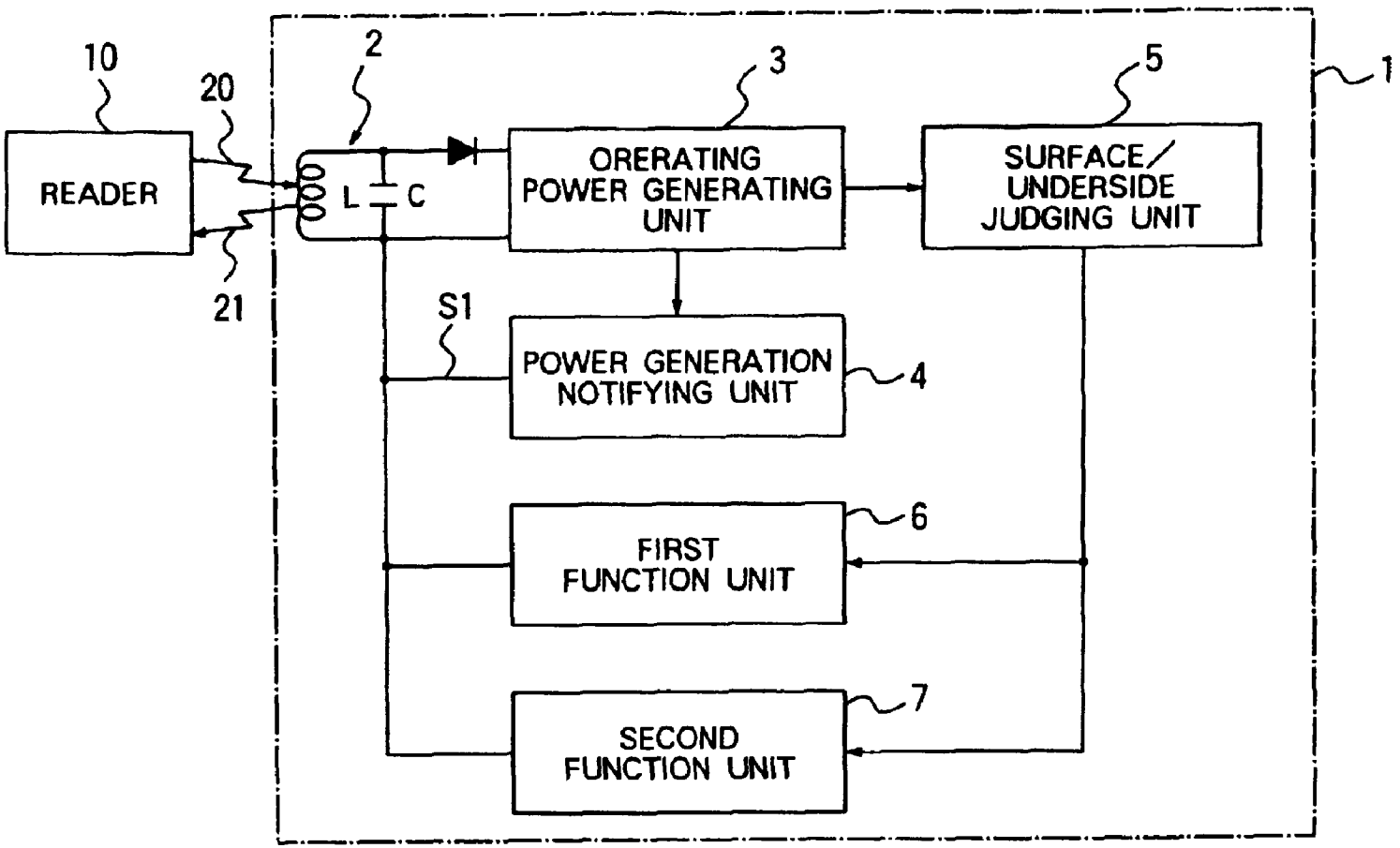
FIG. 2 is a block diagram showing a first embodiment of a data carrier according to the present invention.

FIG. 2 is a block diagram showing a non-contact type data carrier in a first embodiment of the present invention. This non-contact type data carrier 1 takes a card-like shape, and, as shown in FIG. 2, includes an antenna circuit 2, an operation power generating unit 3, a power generation notifying unit 4, a surface/underside judging unit 5, a first function unit 6 and a second function unit 7.

The antenna circuit 2 is constructed of a resonance circuit in which a coil and a capacitor C are connected in parallel. The antenna circuit 2 is provided to receive radio waves 20 transmitted from a reader 10 and to transmit radio waves 21 to the reader 10 from the non-contact type data carrier 1.

The operation power generating unit 3 is structured to generate operating electric power for the non-contact type data carrier 1 by the antenna circuit 2 receiving the radio waves 20 transmitted from the reader, and to store the electric power generated through a magneto-electric induction in a capacitor (unillustrated).

The power generation notifying unit 4 detects that the operation power generating unit 3 stores the capacitor with a predetermined quantity of electric power, and notifies the reader of this effect. The power generation notifying unit 4 outputs a completion-of-charging signal S1 to the antenna circuit 2, and notifies the reader of it by transmitting the radio waves 21 from the antenna circuit 2. A communication frequency of the radio waves used herein are, for example, 125 kHz band, 13-56 MHz band and other microwave band.

The surface/underside judging unit 5 judges whether the non-contact type data carrier 1 is positioned on the surface side or on the underside with respect to the reader 10. The surface/underside judging unit 5 distinguishes between the surface and the underside of the non-contact type data carrier 1 on the basis of a direction of the electric current induced in the coil L when the transmission of the radio waves 20 from the reader 10 is interrupted and thereafter resumes after the notification has been given by the power generation notifying unit 4.

The first function unit 6 operates when the surface/underside judging unit 5 judges that the non-contact type data carrier 1 is positioned on the surface side. An arbitrary function can be adopted as a first function thereof, and there is, e.g., a commuter pass process used in a traffic system.

The second function unit 7 operates when the surface/underside judging unit 5 judges that the non-contact type data carrier 1 is positioned on the underside, and there is adopted, e.g., an automated ticket inspecting process of the commuter pass in the traffic system, which process is different from the first function.

Further, there may be freely selected a variety of combinations such as making the commuter pass for plural types of traffics like an A-traffic and a B-traffic function as the first function, and making an ID card process of a user function as the second function.

Next, a procedure of the processes executed between the non-contact type data carrier 1 and the reader 10, will be explained with reference to a flowchart in FIG. 3.

Figure 3:
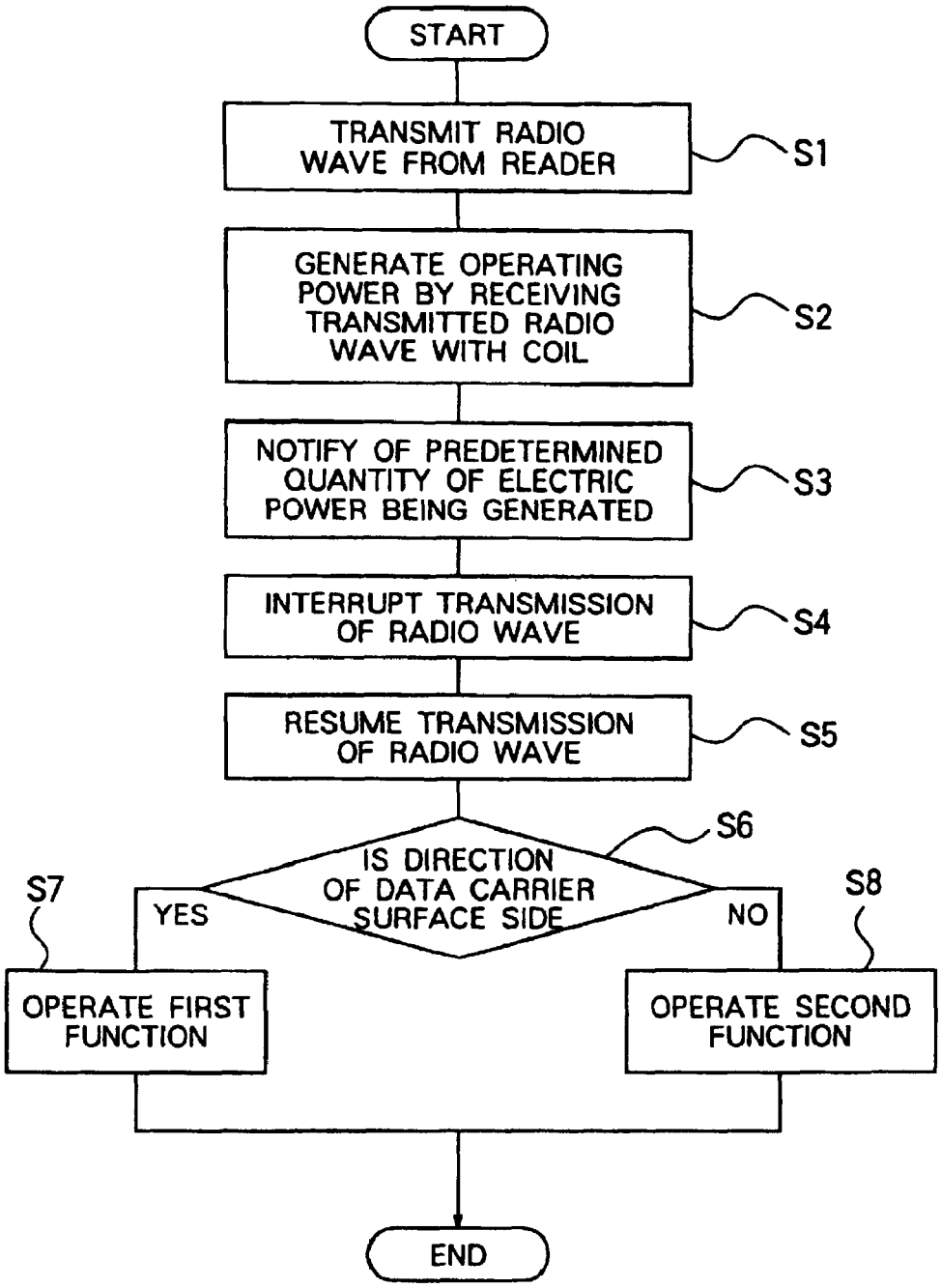
FIG. 3 is a flowchart showing a processing procedure using the data carrier illustrated in FIG. 2.

As shown in FIG. 3, the radio waves 20 are transmitted from the reader 10 in step S1. The non-contact type data carrier 1 receives the radio waves through the antenna circuit 2, and next the operation power is generated in step S2.

Next, the processing proceeds to step S3, whether or not the predetermined quantity of operation power is generated is detected, and, when the capacitor is charged with the predetermined quantity of electric power, the reader 10 is notified of this charging. The reader 10, when notified of the capacitor being stored with the predetermined quantity of operation power from the non-contact type data carrier 1, interrupts the transmission of the radio waves 200 for a predetermined period of time as shown in step S4. This interruption is conducted for just a time necessary for the non-contact type data carrier 1 to recognize the interruption of the radio wave 20 transmission.

The reader 10, after a predetermined time has elapsed since the transmission of the radio waves 20 were interrupted, resumes the transmission of the radio waves 20 as shown in step S5.

The reader 10 receives the radio waves 20 transmitted after the interruption for the predetermined time, and makes the judgment about the surface and the underside of the non-contact type data carrier 1 on the basis of the direction of the electric current flowing across the coil L as shown in step S6.

Then, as a result of this surface/underside judgment, when judging that the non-contact type data carrier 1 is positioned on the surface side, the processing proceeds to step S7, and the first function is made operative.

While on the other hand, as a result of the judgment in step S6, when judging that the non-contact type data carrier 1 is positioned on the underside, the processing proceeds to step S8, and the second function is made operative.

Figure 4A:
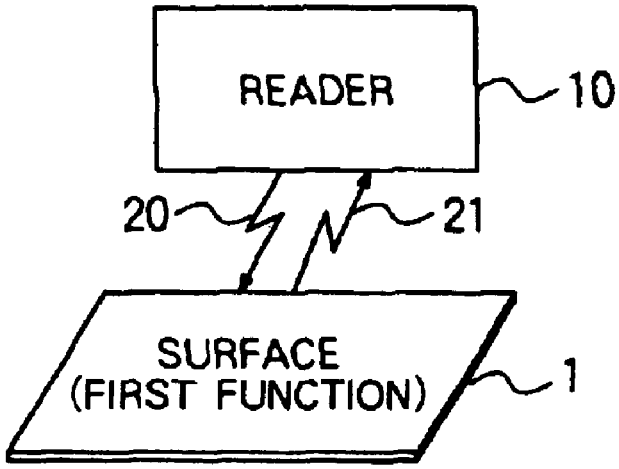
FIGS. 4A and 4B are explanatory diagrams each showing how different functions are executed corresponding to the surface and the underside of the data carrier with respect to a card reader.

With the operations performed as discussed above, when the surface is directed to the reader 10, the non-contact type data carrier 1 in the first embodiment operates the first function unit 6 as shown in FIG. 4A, and the information is transmitted and received between the first function unit 6 and the reader 10.

Figure 4B:
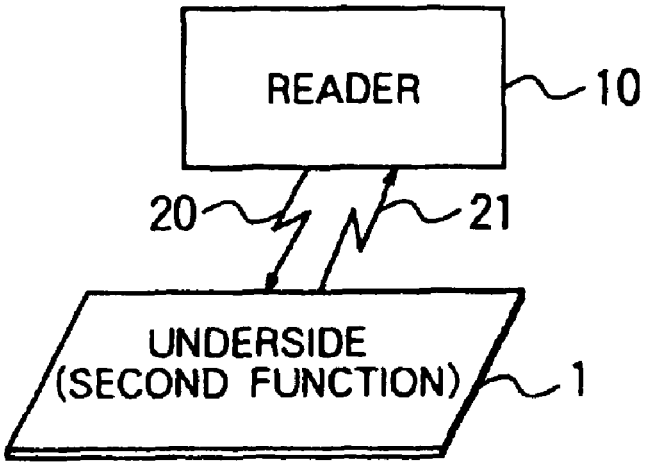

Further, as shown in FIG. 4B, when the underside is directed to the reader 10, the second function unit 7 operates, and the information is transmitted and received between the second function unit 7 and the reader 10.

Next, a much more specific configuration of a non-contact type data carrier 100 corresponding to the non-contact type data carrier 1 shown in FIG. 2 will be described with reference to a block diagram in FIG. 5.

Figure 5:
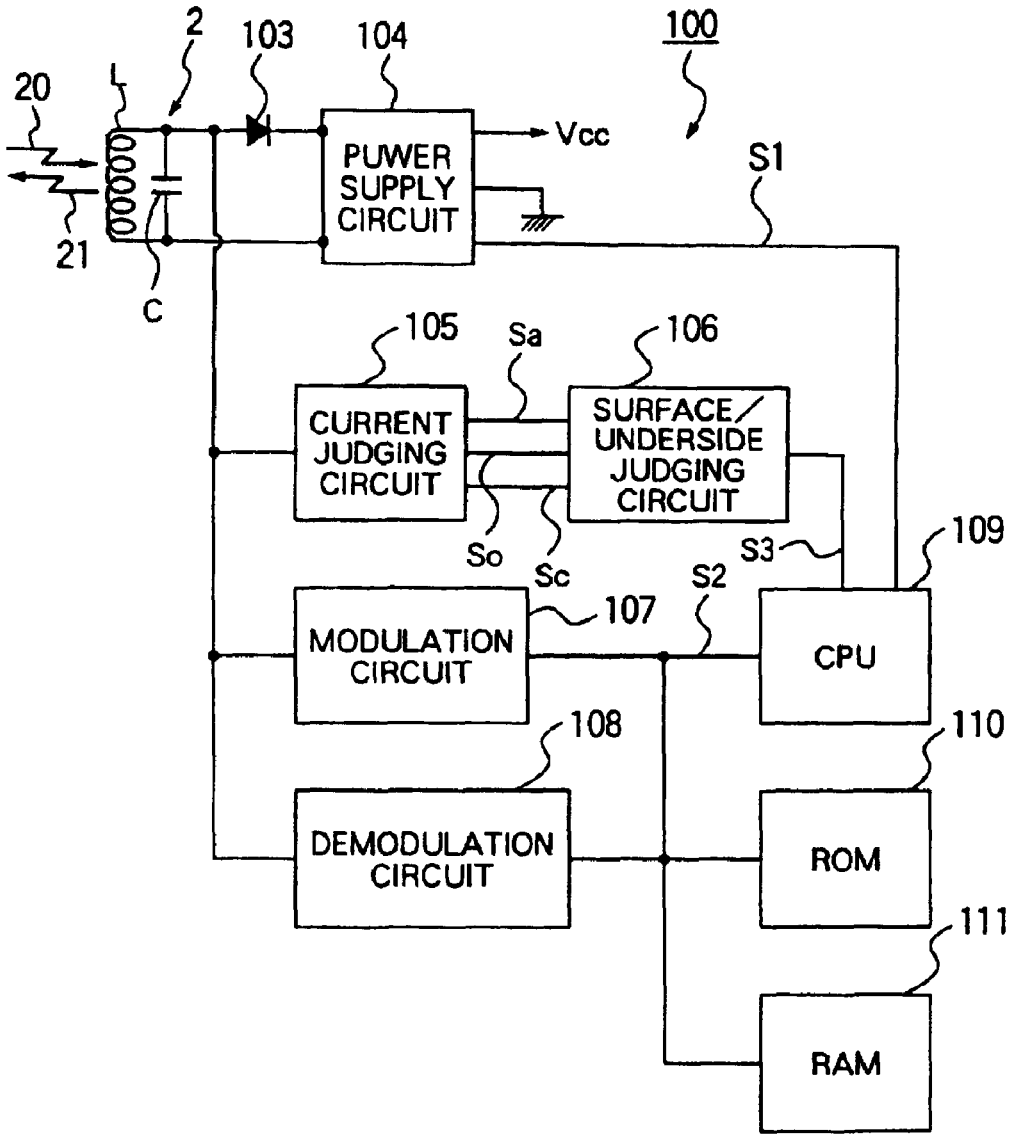
FIG. 5 is a block diagram illustrating a more detailed configuration of the data carrier shown in FIG. 2.

As illustrated in FIG. 5, the non-contact type data carrier 100 includes the coil L connected in parallel, the antenna circuit 2 constructed of the capacitor C, a rectifier circuit 103, a power supply circuit 104, a current judging circuit 105, a surface/underside judging circuit 106, a modulation circuit 107, a demodulation circuit 108, a CPU 109, a ROM 110 which stores an operation program for the CPU 109, and a RAM 111 which stores rewritable data. An electrically erasable and programmable ROM (EEPROM) can be sued as the ROM, and a capacity thereof is, though generally under 8 k bytes, may also be 16 k bytes, 32 k bytes, 64 k bytes, 128 k bytes, 256 k bytes, 512 k bytes and 1 M bytes.

In the non-contact type data Carrier 100, upon receiving the radio waves 20 transmitted from the reader 10, the voltage is induced in the coil L, and the electric current flows. This current is supplied via the rectifier circuit 103 to the power supply circuit 104. This power supply circuit 104 thereby generates the operation power, and a power charging capacitor (unillustrated) is charged with the operation power.

Then, when the capacitor has completely been charged with the electricity, the power supply circuit 104 transmits the completion-of-charging signal S1 to the CPU 109. The CPU 109 receiving this completion-of-charging signal S1 outputs via the modulation circuit 107 to the antenna circuit 2 a signal S2 indicating that it becomes feasible to make the surface/underside judgment.

The signal S2, indicating that it becomes feasible to make the surface/underside judgment, is converted by the antenna circuit 2 into a radio wave 21 and transmitted to the reader 10.

The reader 10, when the signal S2 indicating that the surface/underside judgment becomes possible is transmitted from the non-contact type data carrier 1, the transmission of the radio waves 20 is stopped for a period longer than at least a period of the carrier wave and shorter than a time for which the electric power given to the power charging capacitor is discharged till the non-contact type data carrier 1 becomes incapable of operating.

On the other hand, in the non-contact type data carrier 1, the current judging circuit 105 always judges where the current flowing across the coil L is directed, and, based on this judgment, a positive direction signal Sa, a current-O signal S0, and a negative direction signal Sc are generated and continue to be transmitted to the surface/underside judging circuit 106. Note that the positive direction signal Sa and the negative direction signal Sc are in an inverted relationship in a status of receiving the radio waves 200 from the reader 100, and hence the negative direction signal Sc is given as an inverted signal of (positive direction signal Sa AND zero-current signal S0).

The surface/underside judging circuit 106, when supplied with the electric power and once brought into an operating status, monitors whether or not the zero-current signal S0 transmitted from the current judging circuit 105 becomes ≡HV for a time equal to or longer than at least the period of the carrier wave.

Figure 6:
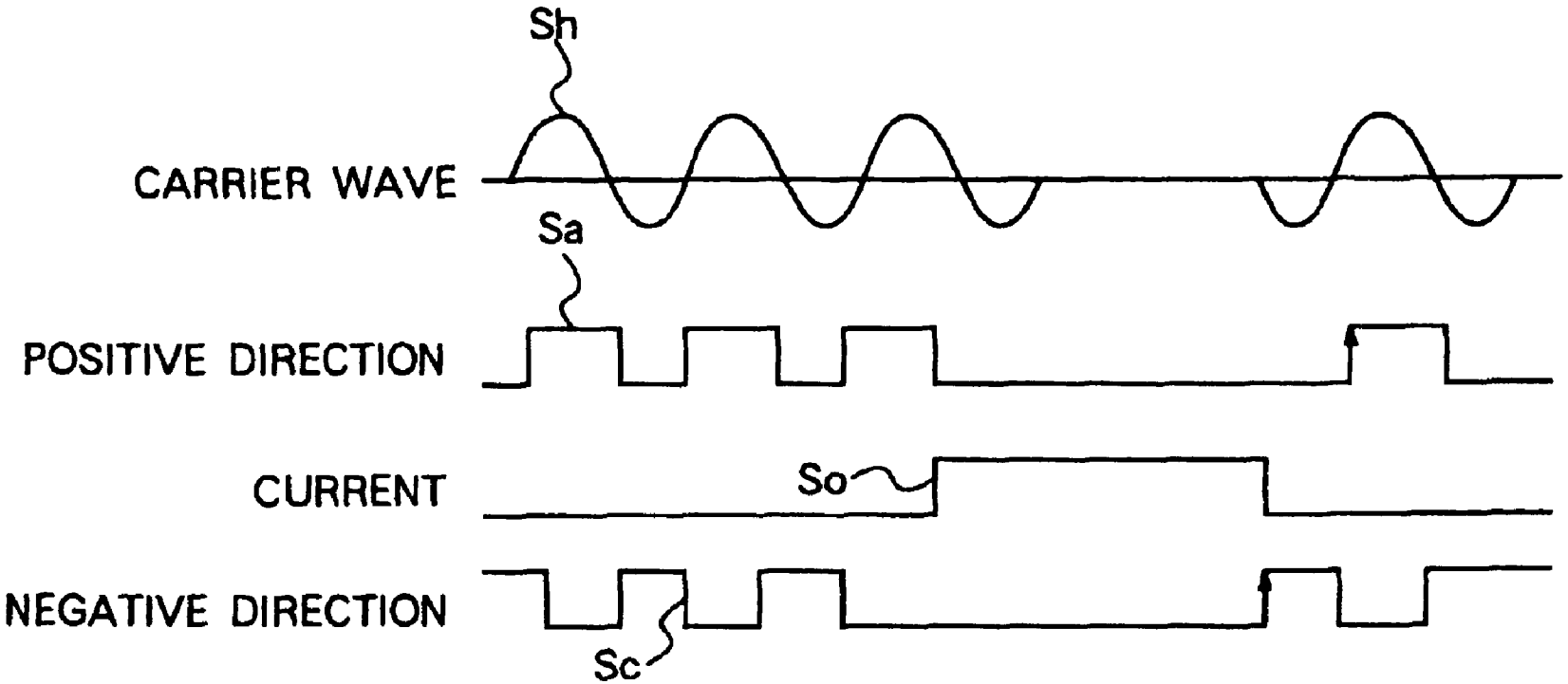
FIG. 6 is a characteristic diagram in FIG. 5.

Then, as shown in a characteristic diagram of FIG. 6, when the transmission of the radio waves 20 from the reader 10 is stopped, the zero-current signal S0 assumes an ≡HV level. Further, the transmission of the radio waves 200 is stopped for the time longer than the period of the carrier wave Sh, and therefore the surface/underside judging circuit 106 surely detects that the transmission of the radio waves 200 is stopped.

Then, the surface/underside judging circuit 106 monitors which signal, the positive direction signal Sa or the negative direction signal Sc, rises first at the ≡HV level at a timing when the transmission of the radio waves 200 resumes.

A determination of which signal, the positive direction signal Sa or the negative direction signal Sc, rises first arises at ≡HV level, is uniquely made in accordance with the direction of the surface and the underside of the non-contact type data carrier 1 as well as with a phase of the carrier wave Sh when the transmission of the radio waves 20 resumes. Therefore, if the phase of the carrier wave Sh at the resumption of the radio wave 20 transmission is preset in a predetermined phase, it is feasible to surely distinguish between the surface and the underside of the non-contact type data carrier 1.

Then, as described above, the user is able to selectively freely use the first function and the second function depending on which side, the surface or the underside, of the non-contact type data carrier 1 is set upward when used.

In accordance with the first embodiment, the first and second functions are independent of each other, and hence, if the data is transmitted and received to and from the reader 10 by making the first function operate, the second function does not get involved in the operation at all. Further, reversely if the data is transmitted and received to and from the reader 10 by making the second function operate, the first function does not get involved in the operation at all.

Accordingly, it never happens that the data stored in the second function might be transmitted while the data is transmitted and received to and from the reader 10 by use of the first function. Therefore, when the communications are conducted by use of the first function, even if information that should be kept confidential during the communications using the first function is stored in the second function, there never arises such a problem that this piece of information is leaked out unexpectedly. Similarly, during the process of transmitting and receiving the data to and from the reader 10 by use of the second function, it never happens that the data stored in the first function might be transmitted.

With such a construction, the same functions as those of two sets of data carriers can be actualized by using the single non-contact type data carrier 1 in accordance with the first embodiment.

Incidentally, in the embodiment shown in FIG. 5, the surface/underside judging circuit 106 is shown separately from the CPU 109. The CPU 109 may also be, however, contrived to perform the surface/underside judging function as illustrated in a constructive diagram of FIG. 7 by way of a modified embodiment thereof.

If constructed in this way, the CPU 109 performs an interrupt operation just when the zero-current signal S0 is inputted from the current judging circuit 105, and executes a surface/underside judging program. This surface/underside judging program is kept in a standby status until an interruption by the positive direction signal Sa or the negative direction signal Sc occurs. When the interruption by one of these signals occurs, the surface/underside judgment is made from a result thereof, and the RAM 111 is stored with the result of the judgment, and any one of the first and second functions is operated based on the result of the judgment.

Second Embodiment

Figure 8:
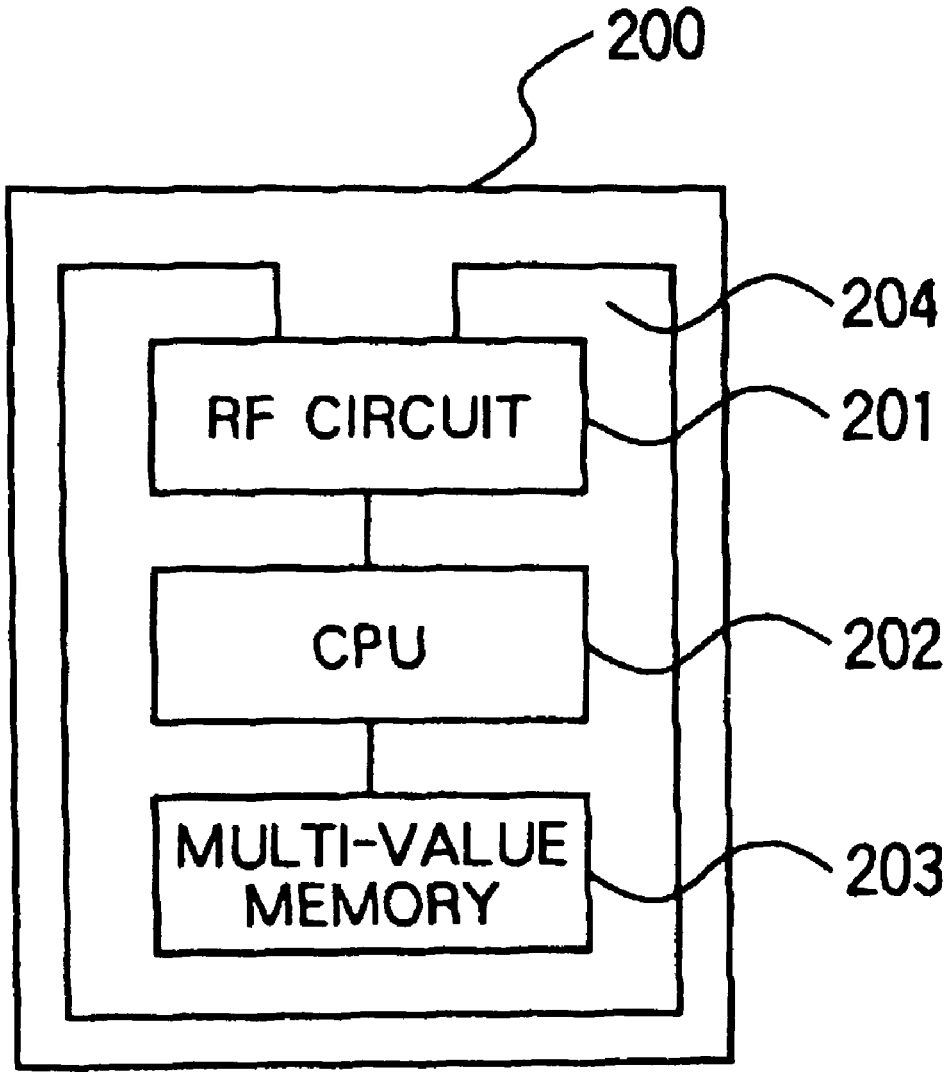
FIG. 8 is a block diagram showing a second embodiment of the data carrier according to the present invention.

FIG. 8 is a block diagram showing a second embodiment of the non-contact type data carrier according to the present invention.

A data carrier 200 includes an RF circuit 201, a CPU 202 connected to this RF circuit 201, a built-in antenna 404 connected to the RF circuit 201, and a multi-value memory 203 connected to the CPU 202.

The RF circuit 201 transmits and receives various items of data to and from the reader 10 by using the radio waves, e.g., high-frequency radio waves (RF signals) in a radio wave frequency bandwidth, which are received by the built-in antenna 404, and generates internal power source electric power by utilizing energy of the radio waves transmitted. Details thereof are the same as those shown in FIG. 2 or 5, and the internal power source electric power is obtained by rectifying into a DC voltage an AC voltage induced corresponding to a change in a magnetic field generated by the radio wave signals 20 transmitted from the reader 10.

The CPU 202 is, e.g., a microprocessor and controls operations of the respective circuits by executing a variety of commands in accordance with contents of storage in the multi-value memory 203. The CPU 202, in the case of the microprocessor, has a sufficient capability equivalent to a 4-bit microcomputer having generally a 12-bit data width. In the case of involving a complicated process like a cryptanalysing process as will be mentioned later on, there is used a CPU the performance of which is higher than a 16-bit microcomputer having a 32-bit data width. Note that if the function required is extremely limited, there may be a combination of simple logic circuits.

The multi-value memory 203 is recorded with information peculiar to a card 200, e.g., the peculiar information for specifying the card in addition to the control program for the CPU 202 to execute a variety of commands.

Thus, the CPU 202 and the multi-value memory are incorporated into the card 200, i.e., the data carrier card, and it is feasible to control the operations of a variety of circuits and also to simultaneously recognize the radio waves transmitted and received by a multiplicity of data carrier cards. Further, it is also possible to simultaneously perform a plurality of operations and to reduce a processing time of the circuits as a whole.

Figure 9:
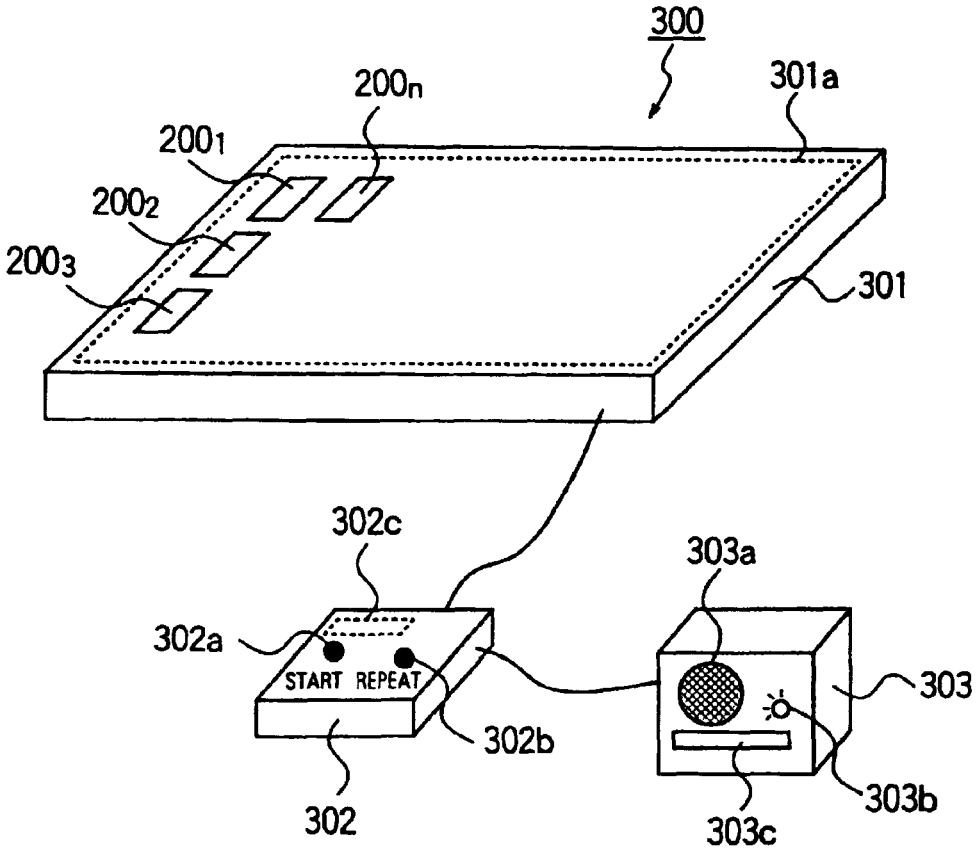
FIG. 9 is a perspective view showing a first embodiment of a game apparatus according to the present invention, which uses the data carrier shown in FIG. 8.

FIG. 9 is a perspective view showing a first embodiment of a game apparatus using the data carrier illustrated in FIG. 8.

This game machine 300 includes a game board 301 incorporating an antenna 301*a*, a host computer 302 connected to this game board 301, and a vocalizing device 303 connected to the host computer 302. An n-pieces of cards $\mathbf{200}_1$-$\mathbf{200}_n$ are placed in arbitrary positions on the game board 301. Multi-value memories $\mathbf{203}_1$-$\mathbf{203}_n$ of these cards $\mathbf{200}_1$-$\mathbf{200}_n$ are stored with different items of information for recognizing the respective cards. A multi-value memory is composed of a multi-value memory cell having a control gate and a charge storing layer which can exhibit three or more different storing states, and the multi-value memory cell takes one of the three or more storing states.

Further, the host computer 302 is provided with a start button 302*a* for starting a game, a repeat button 302*b* for uttering a voice of card reading once again, and a memory 302*c* stored with various kinds of control programs. The host computer 302 executes the control program stored in the memory 302*c* and thereby controls the transmission and receipt through the antenna 301*a* and controls an operation of the vocalizing device 303 in accordance with the operations of the respective buttons. The memory 303*c* is previously stored with the control programs according to a flowchart as shown in, e.g., FIG. 10.

Moreover, the vocalizing device 303 is provided with a loud speaker 303*a* for vocalizing the card reading, a volume knob 303*b* for controlling a vocalization volume, and an insertion port 303*c* into which an information medium such as a CD-ROM (Compact Disk Read Only Memory) etc stored with the information on the card to be read. The vocalizing device 303 vocalizes through the loud speaker 303*a* on the basis of the voice information read from the information medium inserted into the insertion port 303*c* under the control of the host computer 302.

The antenna 301*a* f the game board 301 transmits and receives the radio waves to and from respective cards $\mathbf{200}_1$-$\mathbf{200}_n$.

Next, a series of operations of the thus constructed card game machine 300 will be explained.

What is shown herein is a game in which players catch the card related to the message information transmitted in voices quicker than others, and thus compete with others to acquire more of cards.

To start with, the player arranges the cards $\mathbf{200}_1$-$\mathbf{200}_n$ in arbitrary positions on the game board 301. A range in which the cards $\mathbf{200}_1$-$\mathbf{200}_n$ can be arranged on this game board 301 is set equal to a range in which the antenna 301*a* is capable of transmitting and receiving the data to and from the cards $\mathbf{200}_1$-$\mathbf{200}_n$. The host computer 302 thereby becomes capable of recognizing only the cards arranged on the game board 301. Namely, it never happens that the host computer 302 recognizes an existence of the card not existing on the game board 301.

Upon a preparation for the game described above, the host computer 302 executes the control program stored in the memory 302*c*.

Based on this control program, the game machine 300 operates in the way which follows.

Figure 10:
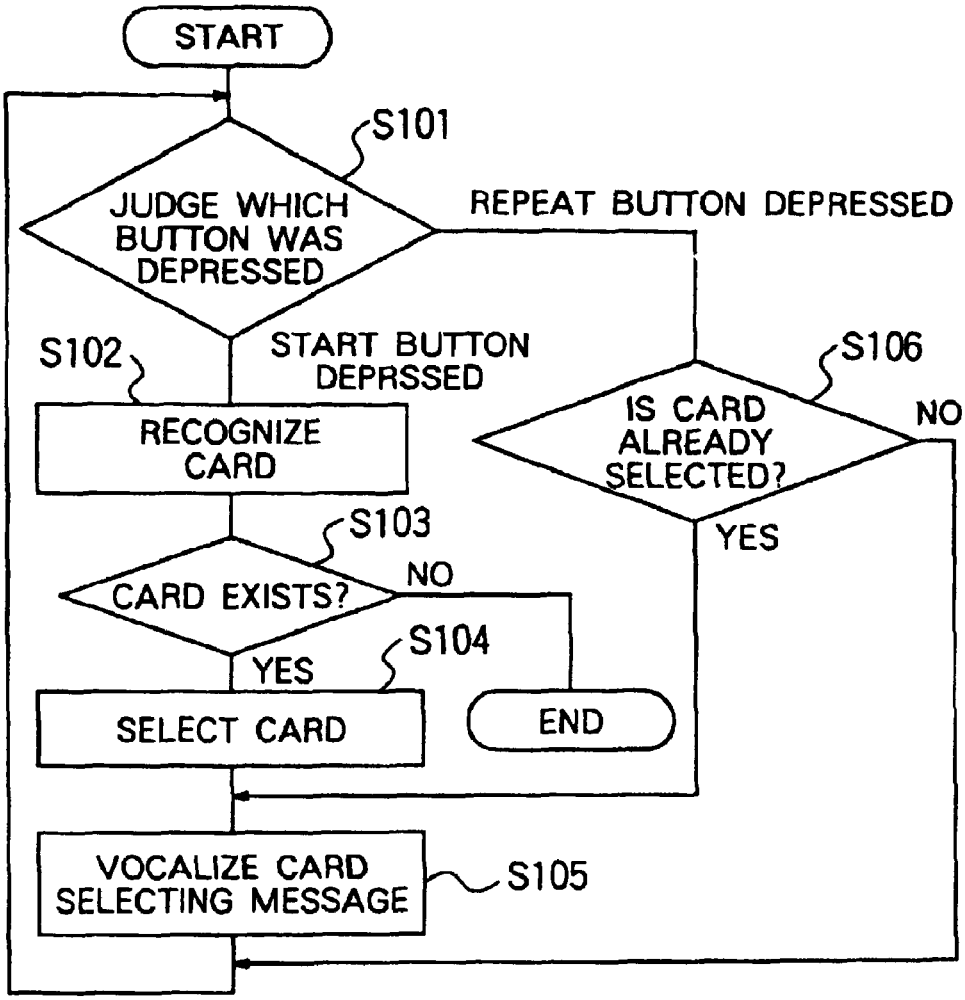
FIG. 10 is a flowchart showing how the game apparatus shown in FIG. 9 operates.

Specifically, as shown in FIG. 10, the host computer 302 judges whether the start button 302*a* or the repeat button 302*b* is depressed (step S101).

As a result of the judgment in step S101, if it is judged that the start button 302*a* is depressed, the host computer 302 recognizes this depression and a radio wave (inquiry signal) for confirming the existence of the individual card is transmitted from the antenna 301.

Each of the cards $\mathbf{200}_1$-$\mathbf{200}_n$ on the game board 301 which receives this signal is brought into an actuated status by each of the RF circuits $\mathbf{201}_1$-$\mathbf{201}_n$, and the received radio wave is judged by each of the CPU $\mathbf{202}_1$-$\mathbf{202}_n$. Then, the necessary information, e.g., an identification code for identifying the card is read from each of multi-value memories $\mathbf{203}_1$-$\mathbf{203}_n$ and transmitted from each of antennas $\mathbf{404}_1$-$\mathbf{404}_n$.

Accordingly, the host computer 302 recognizes the card existing on the game board 301 from the identification code given from each of the cards $\mathbf{200}_1$-$\mathbf{200}_n$, which is received by the antenna 301*a* built in the game board 301 (step S102).

Next, the host computer 302 judges whether or not the card exists on the game board 301, using a result of the confirming process in step S102 (step S103).

As a result of the judgment in step S103, the host computer 302 selects at random an arbitrary card among the cards 7 existing thereon, and supplies the vocalizing device 303 with information indicating the selected card (step S104).

The vocalizing device 303, with the information supplied from the host computer 302, reads from the information medium a message related to the card selected by the host computer 302, and vocalizes through the loud speaker 303*a*

(step S105). At this time, the vocalizing device 303 utters a voice of the message with a volume value set by the volume button 303*b*.

In accordance with the voice uttered from the vocalizing device 303, the player takes the related card among the cards existing on the card board 301. Then, the operation returns to the judging process in step S101, and the play for a next card starts with depressing again the start button 302*a*.

Further, if any players were unable to find out that card promptly after the process in step S105, the player pushes the repeat button 302*b* of the host computer 302.

In this case, it is judged in step S101 that the repeat button 302*b* is depressed, and whether in a status after finishing the card selecting process in step S104 or not, i.e., whether the card has already been selected or not, is judged in step S106.

As a result of the judgment in step S106, if the card has not already been selected, the host computer 302 returns to the judging process in step S101, and, if already selected, advances to a process of vocalizing the message in step S105. This being done, it follows that the same message as the last time is uttered from the vocalizing device 303.

The processes described above are repeated till the cards disappear on the game board. Then, as a consequence of the judgment in step S103, all the cards on the game board 301 are taken out and come to no existence on the game board 301, in which case the host computer recognizes this and the process of the present play is finished. Then, the player who gains the largest number of cards is a winner.

As discussed above, the construction in the first embodiment is that the respective cards $\mathbf{200}_1$-$\mathbf{200}_n$ are constructed of the non-contact type data carriers, the host computer 302 recognizes the card existing on the card board 301 by transmitting the radio wave from the antenna 301*a* built in the card board 301, and the vocalizing device 303 utters the voice of the message corresponding to the card selected at random from the cards existing thereon.

This construction eliminates the necessity for a referee and a reader other than the players as needed in the prior art. Namely, the game can proceed without reader of the message and can be also conducted if there are two participants. Further, only one player is able to perform the game, and hence the game machine is also usable for an exercise for the competition.

Moreover, the host computer 302 is capable of recognizing only the cards existing on the game board 301, whereby it never happens that the host computer 302 might mis-recognize the already-taken card.

Furthermore, the cards $\mathbf{200}_1$-$\mathbf{200}_n$ are constructed of the non-contact type data carriers incorporating the CPUs $\mathbf{202}_1$-$\mathbf{202}_n$ and the multi-value memories $\mathbf{203}_1$-$\mathbf{203}_n$. With this construction, a retained information quantity and a throughput can be remarkably enhanced, and, for example, only the required information among pieces of information stored in the multi-value memories can be sent back on the basis of the radio wave signals transmitted from the host computer 302 without unconditionally sending back the information in accordance with the radio wave signals given from the host computer as in the prior art. Alternatively, the game machine can be operated based on the radio wave signals transmitted from the host computer 302.

Still further, the respective cards $\mathbf{200}_1$-$\mathbf{200}_n$ are so constructed as to be operable by the CPU judging the information indicated by the radio wave signal from the host computer 302. With this construction, even in such a case as to individually control the cards $\mathbf{200}_1$-$\mathbf{200}_n$, there is no necessity for differentiating the resonance frequencies for operating the respective cards $\mathbf{200}_1$-$\mathbf{200}_n$. Therefore, it is not required to prepare the radio wave signals corresponding to the number of cards, which are transmitted by the host computer.

Note that the second embodiment discussed above has exemplified the case in which the present invention is applied to the card game and is, as a matter of course, applicable to card games based on a variety of rules.

Third Embodiment

Next, a third embodiment of the data carrier used in the present game apparatus will be explained. The third embodiment shows a modified example of the card 200 in the second embodiment.

Figure 11:
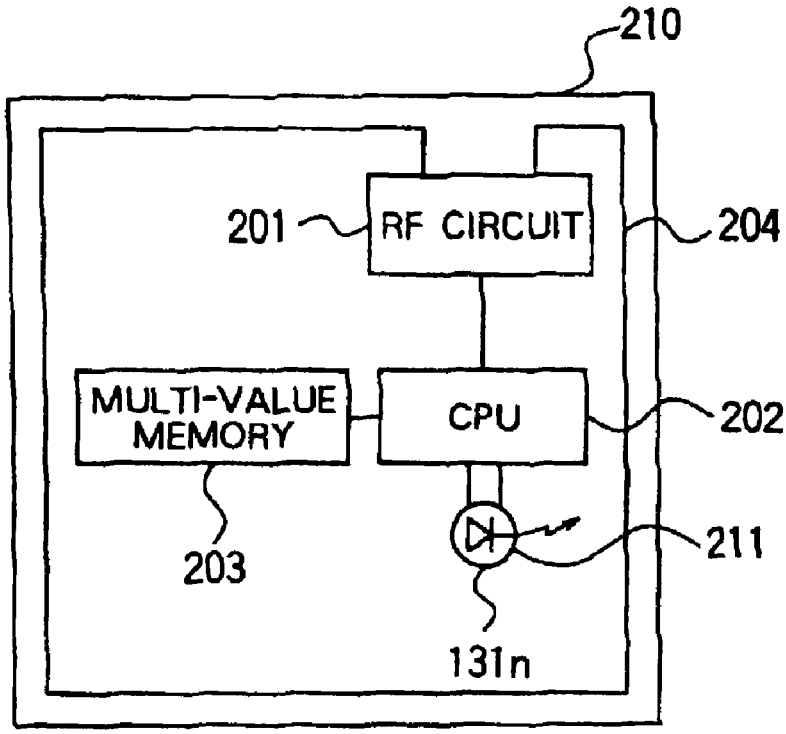
FIG. 11 is a block diagram showing a third embodiment of the data carrier according to the present invention.
Figure 12:
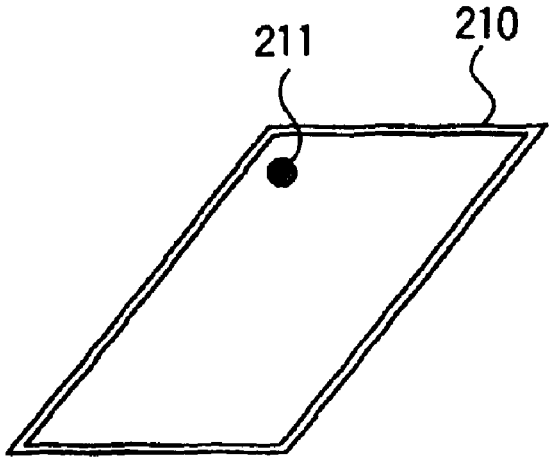
FIG. 12 is a perspective view showing an external appearance of the data carrier shown in FIG. 11.

To be more specific, as shown in a block diagram of FIG. 11, a card 210 is provided, in addition to the configuration illustrated in FIG. 8, with an LED 211 connected to a CPU 202. This card has an external appearance as shown in a perspective view of FIG. 12 and is structured so that an LED 211 is embedded in a part of the card surface.

In the case of using the thus structured card, the host computer 302 transmits, through the antenna 301*a*, the radio wave indicating one card selected among the cards existing on the game board 301. Then, the respective $\mathbf{200}_1$-$\mathbf{200}_n$ receiving this radio wave make the CPUs $\mathbf{202}_1$-$\mathbf{202}_n$ judge whether or not the card indicated by the received radio wave is identical with the self-card. If identical each other, one of the LEDs $\mathbf{211}_1$-$\mathbf{211}_n$ is lit up.

With this contrivance, for instance, if the card $\mathbf{200}_n$ among the cards existing on the card board 301 is selected, the LED $\mathbf{211}_n$ is lit up, and simultaneously a message corresponding to the card $\mathbf{200}_n$ is read by the vocalizing device 303.

Then, the players make the competition of seeking and taking the card with the LED lit up.

As discussed above, in accordance with the second embodiment, the respective cards $\mathbf{200}_1$-$\mathbf{200}_n$ are provided with the visually recognizable elements such as the LEDs $\mathbf{211}_1$-$\mathbf{211}_n$ and operated under the control of the CPUs $\mathbf{202}_1$-$\mathbf{202}_n$. With this construction, the selected card can be visually recognized, and therefore, in addition to the effect obtained in the first embodiment, it is feasible to obtain such an effect that the player is able to recognize the card that should be promptly taken.

Note that the card 200 is provided with the single LED in the third embodiment discussed above, but the present invention is not limited to this construction. For example, the card may be provided with a plurality of LEDs each assuming a different color, and the host computer may control the color to be lit up.

With this contrivance, the player may enjoy the game by setting a rule by which to inhibit a mis-touch due to a confusion in different colors, and so on.

Further, for example, a plurality of patterns on which to light up the LEDs are prepared, and the host computer may designate the same lighting pattern on the cards. With this contrivance, the players may enjoy a memory game, etc.

Fourth Embodiment

Next, a fourth embodiment of the data carrier according to the present invention will be described.

Figure 13:
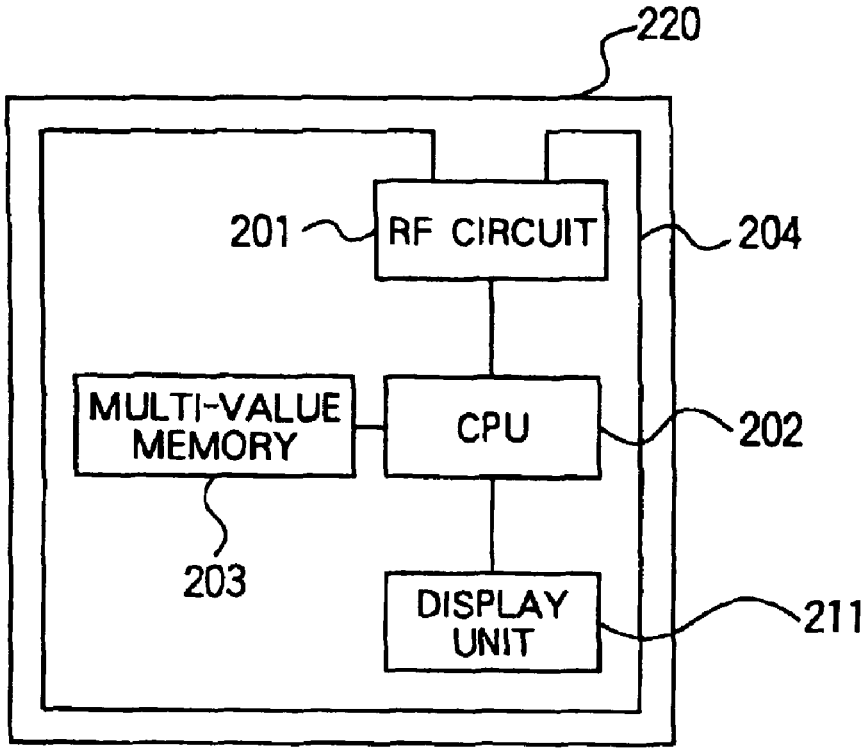
FIG. 13 is a block diagram showing a fourth embodiment of the data carrier according to the present invention.
Figure 14:
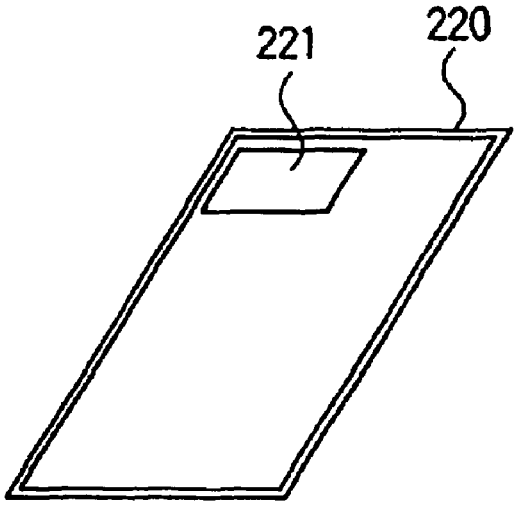
FIG. 14 is a perspective view showing an external appearance of the data carrier illustrated in FIG. 13.

The fourth embodiment also deals with a modified example of the card shown in FIG. 8. In the third embodiment discussed above, the card 210 is provided with the LED 211. Contrastingly, a card 220 in the fourth embodiment is constructed such that a display unit 221 replacing the LED 211 is connected to the CPU as shown in FIG. 13.

Figure 7:
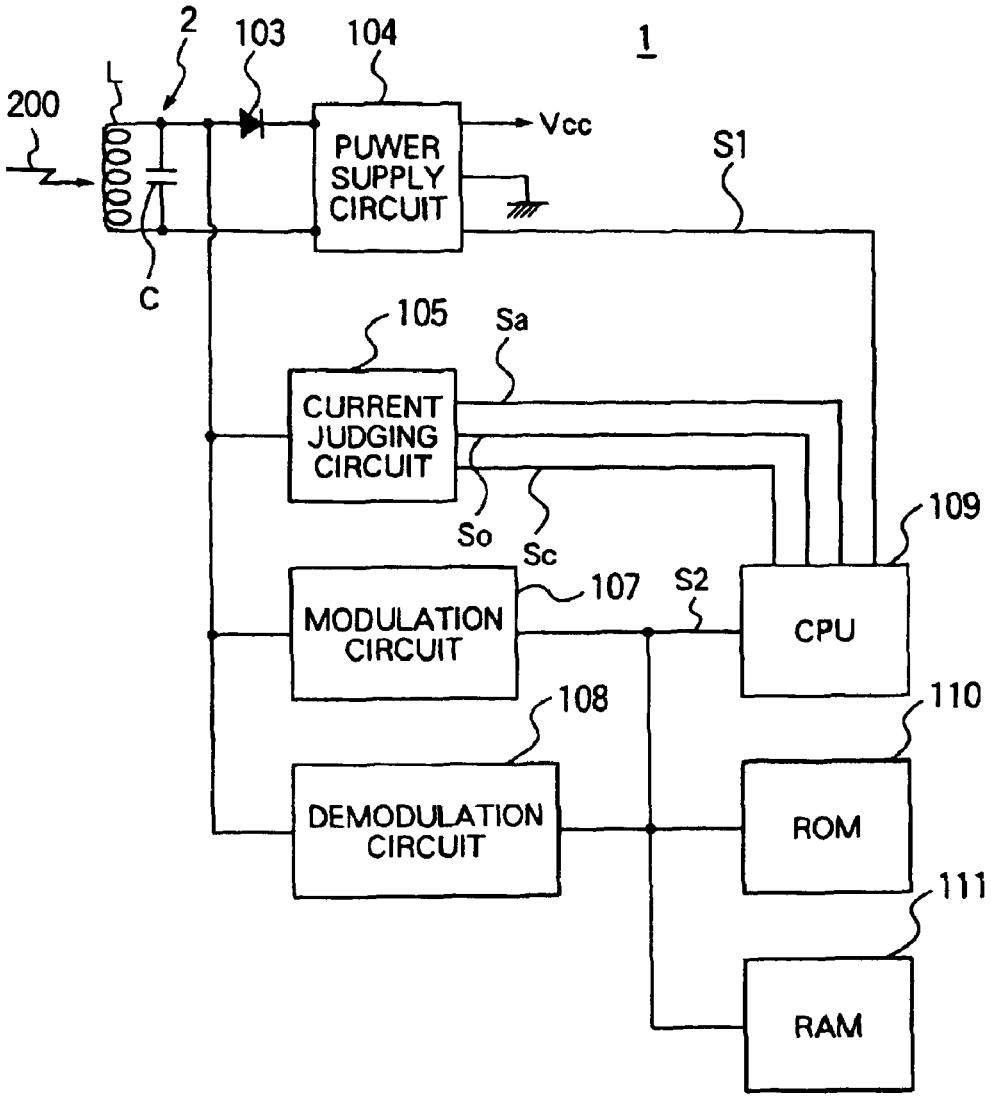
FIG. 7 is a block diagram showing a modified example in FIG. 5.

That is, as shown in FIGS. 7 and 8, the display unit 221 connected to the CPU 202 is provided on a part of the card surface, instead of the LED 211 in the third embodiment discussed above. The display unit may involve the use of a thin and small-sized liquid crystal panel etc.

When using the thus constructed card, the host computer 302 selects in the way described above a single piece of card among the cards existing on the game board 301, and thereafter transmits the radio waves indicating a content of the display as well as indicating the selected card from the antenna 101*a*. In each of the cards $\mathbf{220}_1$-$\mathbf{220}_n$, each of the CPUs $\mathbf{202}_1$-$\mathbf{202}_n$ judges whether or not the card indicated by the received radio wave is identical with the self-card. If identical with each other as a result of the judgment, characters and graphic information, etc, that should be displayed are read out of the multi-value memories $\mathbf{203}_1$-$\mathbf{203}_n$ and displayed on display units $\mathbf{221}_1$-$\mathbf{221}_n$ on the basis of the information on the content of the display which is contained in the radio wave received.

If, for instance, the card $\mathbf{220}_n$ is selected among the cards existing on the card board 301, the content designated by the host computer 302 is displayed on the display unit $\mathbf{221}_n$ of the card $\mathbf{220}_n$, and at the same time the vocalizing device 303 vocalizes a message corresponding to the card $\mathbf{220}_n$.

As discussed above, in accordance with the fourth embodiment, the respective cards $\mathbf{220}_1$-$\mathbf{220}_n$ are provided with the display units $\mathbf{221}_1$-$\mathbf{221}_n$ and are operated under the control of the CPUs $\mathbf{202}_1$-$\mathbf{202}_n$. With this construction, a variety of messages and graphics, etc, can be displayed, and hence the players may enjoy the game by setting peculiar rules using such messages and graphics.

Note that the respective cards $\mathbf{220}_1$-$\mathbf{220}_n$ are provided with the display units $\mathbf{221}_1$-$\mathbf{221}_n$, and the characters and the graphics, etc, are displayed on the display unit of the selected card in the fourth embodiment discussed above. The present invention is not limited to this construction but may take such a construction that, for example, the whole of the card selected or only the characters may be lit up, whereby the players might play the game in the dark.

What has been assumed so far as the data carriers is all of the non-contact type. The non-contact type data carrier is not necessarily used for applications the using frequency of which is not so high, and, in the conventional type data carrier having the terminal connected to the outside, an intelligent function can be incorporated into the data carrier by providing a high-performance CPU and multi-value memory.

Fifth Embodiment

Figure 15:
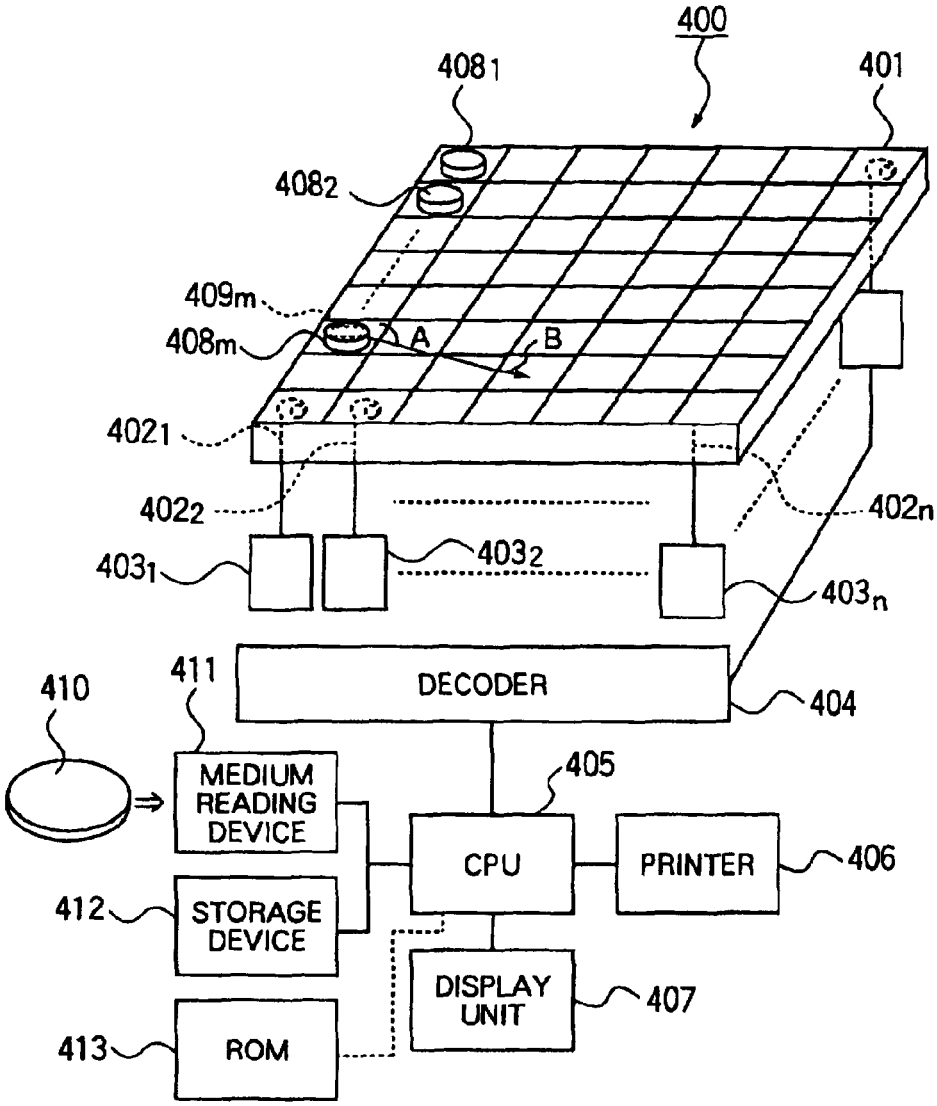
FIG. 15 is a diagram schematically showing a construction in a second embodiment of the game apparatus of the present invention.

Next, a fifth embodiment according to the present invention will be discussed. This embodiment relates to a game apparatus is applied to, e.g., an on-board game machine 400 as illustrated in a schematic constructive view of FIG. 15.

This on-board game machine 400 is constructed so that the player plays a game by moving a plurality of pieces $\mathbf{408}_1$, $\mathbf{409}_m$ $\mathbf{408}_m$ between squares on a game board 401, and is applicable to, e.g., games such as GO, Japanese chess, chess, so-called Othello™, monopoly and backgammon, etc.

The on-board game machine 400 includes antennas $\mathbf{402}_1$, $\mathbf{402}_2$, . . . , $\mathbf{402}_n$ which are built in the game board 401, detectors $\mathbf{403}_1$, $\mathbf{403}_2$, . . . , $\mathbf{403}_n$ connected corresponding to antennas $\mathbf{402}_1$, $\mathbf{402}_2$, . . . , $\mathbf{402}_n$, . . . , a decoder 404 connected to the detectors $\mathbf{403}_1$, $\mathbf{403}_2$, . . . , $\mathbf{403}_n$, a CPU 405 connected to the decoder 404, a printer 406 and a display unit 407 that are each connected to the CPU 405, a medium reading device 411 such as a CD-ROM drive and a floppy disk device for reading a recording medium 410, and a storage device 412 such as a magnetic disk device etc. The medium reading device 411 may be the floppy disk device and the CD-ROM device for reading the medium 410 such as a floppy disk and a CD-ROM stored with a program run for an operation of this on-board game machine. The storage device 412 is stored with such a program and so designed to be accessed by the CPU 405 at all times.

Further, data carriers $\mathbf{409}_1$, $\mathbf{409}_2$, . . . , $\mathbf{409}_m$ having the same constructions as those of, e.g., the data carriers shown in the first through fourth embodiments discussed above, are each incorporated into the plurality of pieces $\mathbf{408}_1$, $\mathbf{408}_2$, . . . , $\mathbf{408}_m$ used for the on-board game machine 400.

Further, the antennas $\mathbf{402}_1$, $\mathbf{402}_2$, . . . , $\mathbf{402}_n$ are each disposed in the squares on the game board 401.

Moreover, each of internal memories in the data carriers pieces $\mathbf{409}_1$, $\mathbf{409}_2$, . . . , $\mathbf{409}_n$ incorporated into the pieces $\mathbf{408}_1$, $\mathbf{409}_m$ $\mathbf{408}_m$ is stored with a self-piece identification code. Note that a construction of each of the data carriers pieces $\mathbf{409}_1$, $\mathbf{409}_2$, . . . , $\mathbf{409}_m$ is the same as that of the data carriers used in the first to fourth embodiments discussed above, and hence a detailed explanation thereof is omitted.

Next, an operation of this game apparatus will be described. Note that the following operation is performed based on a program, read from the medium reading device 411 and stored in the storage device 412, for controlling the whole game apparatus. Given herein is an explanation of the operation of the game machine 400 in a case here the arbitrary piece 408. is disposed in a square A on the game board 401 and then shifted to a square B.

To start with, the CPU 405 transmits the radio waves from the antennas $\mathbf{401}_1$, $\mathbf{408}_2$, . . . , $\mathbf{408}_n$ disposed in the respective squares.

In this state, when the square A on the game board 401, the radio wave transmitted from the antenna disposed in the square A (which antenna is hereinafter referred to as an antenna 402A), is received by the antenna within the data carrier $\mathbf{409}_m$ incorporated into the piece $\mathbf{408}_m$. Then, the identification code of the piece $\mathbf{408}_m$ that is stored in the memory within the data carrier $\mathbf{409}_m$ is transmitted from the above antenna.

The identification code of the piece $\mathbf{408}_m$, which has been transmitted from the data carrier $\mathbf{409}_m$, is received by the antenna 402A. At this time, the detector connected to the antenna 402A (which detector is hereinafter referred to as a detector 403A) detects that the identification code is received by the antenna 402A, i.e., that the piece $\mathbf{408}_m$ exists in the square A, and supplies the decoder 404 with the identification code received by the antenna 402A. Such a detecting process is executed by regularly scanning all the squares at a fixed time interval.

The decoder 404 supplies the CPU 405 with an item of information showing that the piece $\mathbf{408}_m$ exists in the square A from the identification code given from the detector 403A, an item of piece information indicating a type of the piece $\mathbf{408}_m$ and containing an indication about the surface and underside of the piece. The CPU 405 stores the same multi-value memory (unillustrated) as the one shown in FIGS. 8, 11 and 13 with the piece information given from the decoder 404.

Next, when the piece $\mathbf{408}_m$ existing in the square A is shifted to the square B, the radio wave transmitted from the antenna set in the square B (which is hereinafter termed an antenna 402B) is received by the antenna within the data carrier $\mathbf{409}_m$ incorporated into the piece $\mathbf{408}_m$. Then, the identification code of the piece $\mathbf{408}_m$ that is stored in the memory within the data carrier $\mathbf{409}_m$, is transmitted from the above antenna.

The antenna 402B receives the identification code transmitted from the data carrier $\mathbf{409}_m$ of the piece $\mathbf{408}_m$.

At this time, the detector connected to the antenna 402B (which is hereinafter referred to as a detector 403B) detects that the identification code is received by the antenna 402B, i.e., that the piece $\mathbf{408}_m$ exists in the square B, and supplies the decoder 404 with the identification code received by the antenna 402B.

The decoder 404 supplies the CPU 405 with an item of information showing that the piece 408, exists in the square B from the identification code given from the detector 403B, and the piece information containing an indication of a type of the piece $\mathbf{408}_m$.

The CPU 405 stores the unillustrated multi-value memory with the information given from the decoder 404 as next piece information of the piece $\mathbf{408}_m$.

As explained above, with respect to other pieces, one of the detectors $\mathbf{403}_1$, $\mathbf{403}_2$, . . . , $\mathbf{403}_n$, . . . which corresponds to the square to which the piece moves each time, detects this shift and supplies the CPU 405 with this item of information through the decoder 404.

Then, after finishing the game, the player operates the game machine to indicate the CPU 405 to give a display output or a printer output, whereby the CPU 405, in accordance with this indication, displays the piece information of each piece with an advancement from the start and the end of the game on the display unit 407, or alternatively gives a printing output by use of the printer 406.

As discussed above, in the game apparatus in the second embodiment, the data carriers $\mathbf{409}_1$, $\mathbf{409}_2$, . . . , $\mathbf{409}_m$ are incorporated into the pieces $\mathbf{408}_1$, $\mathbf{408}_2$, $\mathbf{408}_m$ and the antennas $\mathbf{401}_1$, $\mathbf{401}_2$, . . . , $\mathbf{401}_m$ are disposed in the respective squares on the game board 401. The CPU 405 is stored with the piece information showing the existence, the type and the surface and underside thereof in communications with the pieces. With this construction, when applied to the game with the established rule, e.g., to Japanese chess, it is feasible to recognize a position of the piece at every movement and to automatically record traces of the pieces as the records of games.

Further, if the detectors $\mathbf{403}_1$, $\mathbf{403}_2$, . . . , $\mathbf{403}_n$ are so constructed as to be capable of making a judgment about the surface and the underside of the piece as explained in FIG. 2, it is possible to easily distinguish between the surface and the underside f the piece, and this construction can be applied to the Othello™ game and Japanese chess.

Incidentally, in the embodiment of the game apparatus described above, the CPU 405 may control advancement of the game in accordance with the existing position of each piece. In the case of the game such as backgammon having a degree of freedom to some extent, an opponent close to winning may be thereby handicapped by giving commands not displayed in the squares such as, for example, ≡onehalt∇, ≡five steps forward!∇, and ≡drawing card∇ etc.

Further, for instance, as in the same way with the third embodiment of the data carrier described above, each of the pieces $\mathbf{408}_1$, $\mathbf{408}_2$, . . . , $\mathbf{408}_m$ is provided with the LED, and the CPU 405 lights up the LED of the piece having moved, and, simultaneously with a movement of the next piece, shifts the lighting spot of the LED to the next piece, whereby the just-theretofore moved piece can be easily recognized.

In the embodiment discussed above, the medium reading device 411 and the storage device 412 are provided, and it is therefore feasible to play different games using the same board in accordance with the program stored therein and games based on different rules. If such an extension is not necessary, however, the above-mentioned can be replaced with a ROM 413 previously stored with the program.

Sixth Embodiment

Figure 16:
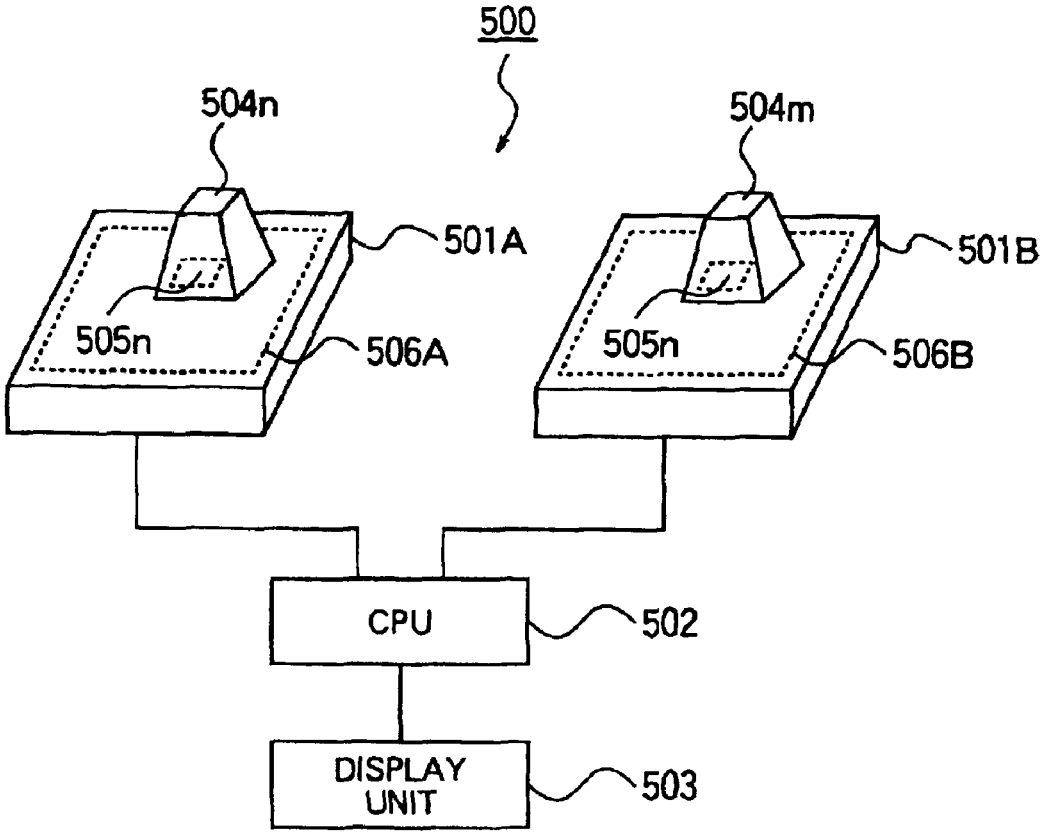
FIG. 16 is a diagram schematically showing a construction in a third embodiment of the game apparatus of the present invention.

FIG. 16 is a schematic constructive diagram showing a third embodiment of the game apparatus according to the present invention.

This game apparatus is capable of refereeing in a game in which a match is determined by evaluation of the pieces used for the game.

This game machine 500 includes, as illustrated in FIG. 16, two game boards 501A, 501B, antennas 506A, 506B incorporated into the two game boards 501A, 501B, a CPU 502 connected to the game boards 501A, 501B, and a display unit 503 connected to the CPU 502.

Further, the respective pieces $\mathbf{504}_n$ and $\mathbf{504}_m$ are placed on the game boards 501A, 501B, and the bottom surfaces thereof are provided with data carriers $\mathbf{505}_n$ and $\mathbf{505}_m$ each having the same construction as the one shown in the first to fourth embodiments. The multi-value memories in these data carriers $\mathbf{505}_n$ $\mathbf{505}_m$ are each stored with information showing a rank of the self-piece.

This game machine 500 is constructed for the player to play with rank-opponents allocated to a plurality of pieces $\mathbf{504}_1$, $\mathbf{504}_2$, . . . .

Then, there will be explained an operation of the game machine 500 in a case where an arbitrary piece $\mathbf{504}_n$ is placed on the game board 501A by one opponent, and an arbitrary piece $\mathbf{504}_m$ is placed on the game board 501B by the other opponent.

To begin with, the CPU 502 transmits the radio waves from the antennas 506A and 506B built in the respective game boards 501A and 501B.

In this state, when the piece $\mathbf{504}_n$ is placed on the game board 501A and the piece $\mathbf{504}_m$ is placed on the game board 501B, the radio waves transmitted from the antennas 506A, 506B are received by the antennas within the data carriers $\mathbf{505}_n$, $\mathbf{505}_m$ incorporated into the respective pieces $\mathbf{504}_n$, $\mathbf{504}_n$. Then, the information stored in the memories within the data carriers $\mathbf{505}_n$, $\mathbf{505}_m$, i.e., the information representing the ranks of the pieces $\mathbf{505}_n$, $\mathbf{504}_m$, are transmitted from the antennas within the data carriers $\mathbf{505}_n$ and $\mathbf{505}_m$.

The antenna 506A receives the information transmitted from the data carrier $\mathbf{505}_n$ of the piece $\mathbf{504}_n$, while the antenna 506B receives the information transmitted from the data carrier $\mathbf{505}_m$ of the piece $\mathbf{504}_m$.

The CPU 502 recognizes the rank of the piece $\mathbf{504}_n$ placed on the game board 501A and the rank of the piece $\mathbf{504}_m$ placed on the game board 501B from the information received by the antennas 506A, 506B, and thus judges whether the piece wins or is defeated. Then, the CPU 502 has a judged result displayed on the display unit 503.

The two opponents are thereby able to easily recognize the win and the defeat of the piece by seeing the screen on the display unit 503.

As discussed above, in accordance with this embodiment, the data carriers $\mathbf{505}_1$, $\mathbf{505}_2$, . . . are incorporated into the respective pieces $\mathbf{504}_1$, $\mathbf{504}_2$, . . . , and the antennas 506A, 506B are built in the game boards 501A, 501B. Then, the CPU 502 recognizes the ranks allocated to the pieces by communicating with the pieces. This construction eliminates, though needed in the prior art, a necessity for one referee for judging whether the piece wins or is defeated, in addition to the two opponents. Namely, only the two opponents are able to play the game.

Further, unlike the prior art, there is no necessity for specially structuring the piece in order to judge whether the piece wins or is defeated, and hence the construction of the game machine can be simplified. As a result, a price of the game machine can be also reduced.

Note that a criterion for the judgment may arbitrarily be set on the occasion of making the judgment about which piece wins. In this case, for example, the CPU 502 stores the multi-value memory with the preset judging criterion, and judges whether the piece wins or not in accordance with the judging criterion stored therein. With this construction, when trying to change the judging criterion for the win and the defeat of the piece, the multi-value memory may simply be stored with a desired judging criterion. Accordingly, there can be freely set the judgment about whether the piece wins or not.

Moreover, in this embodiment, for instance, as in the same way with the third embodiment of the data carrier described above, each of the pieces $\mathbf{504}_1$, $\mathbf{504}_2$, . . . is provided with the LED, and the CPU 502 lights up the LED of the piece which won. The win or defeat of the piece can be thereby promptly easily recognized.

Seventh Embodiment

Next, a seventh embodiment of the game apparatus according to the present invention will be explained.

Figure 17:
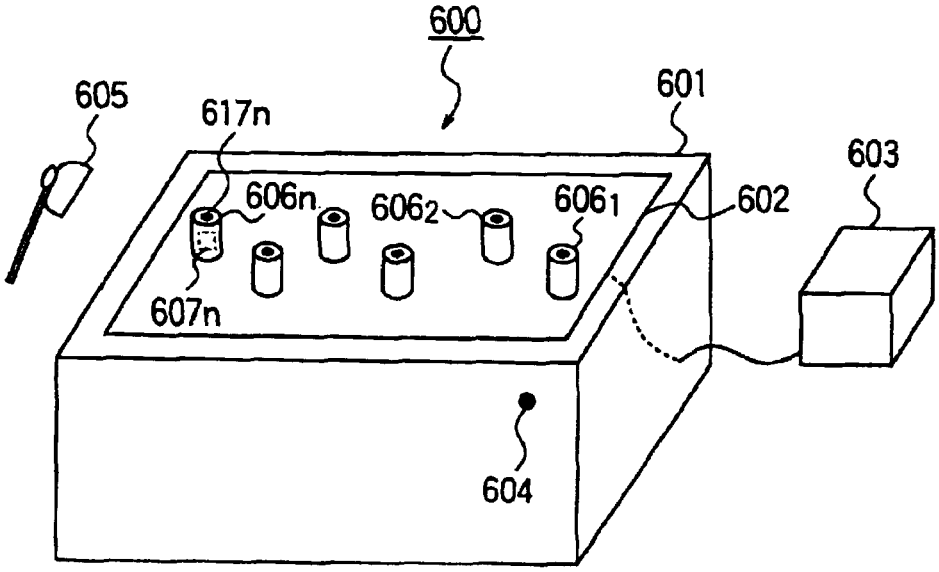
FIG. 17 is a diagram schematically showing a construction in a fourth embodiment of the game apparatus of the present invention.

FIG. 17 shows the game apparatus in the seventh embodiment applied to a game machine 600 for a whack-a-mole game.

This game machine 600, as illustrated in FIG. 17, includes a game board 601, an antenna 602 built in the game board 601, a host computer 603 connected to the antenna 602, and a start switch 604 provided in the game board 601.

Further, a plurality of characters $\mathbf{606}_1$, $\mathbf{606}_2$, . . . , $\mathbf{606}_n$ each taking a shape of mole are provided on the game board 601, and LEDs $\mathbf{617}_1$, $\mathbf{617}_2$, . . . , $\mathbf{617}_n$ that will be mentioned later on, are used as eyes of the characters $\mathbf{606}_1$, $\mathbf{606}_2$, . . . $\mathbf{606}_n$.

Then, data carriers $\mathbf{607}_1$, $\mathbf{607}_2$, . . . , $\mathbf{607}_n$ are incorporated into the respective characters $\mathbf{606}_1$, $\mathbf{606}_2$, . . . , $\mathbf{606}_n$.

Figure 18:
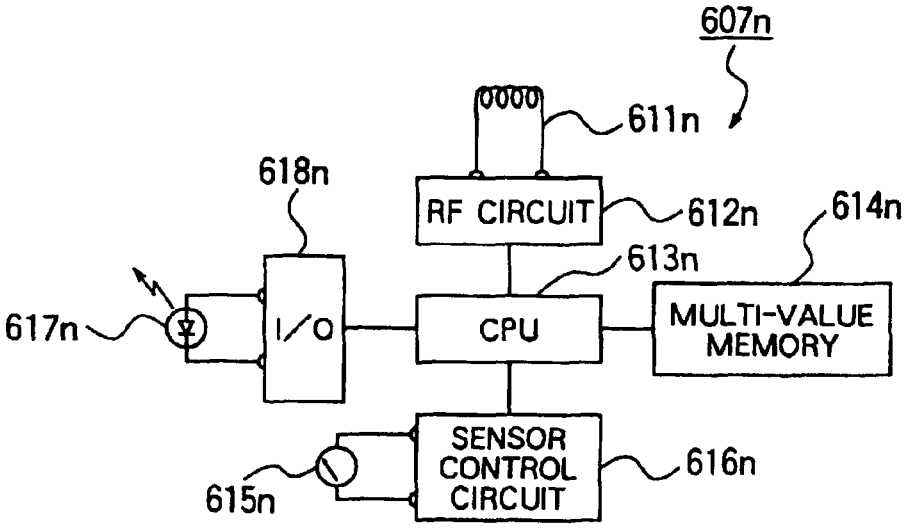
FIG. 18 is a block diagram showing one example of the data carrier used in FIG. 17.

Each of the data carriers $\mathbf{607}_1$, $\mathbf{607}_2$, . . . , $\mathbf{607}_n$ has the same construction. For example, the data carrier $\mathbf{607}_n$ has, as illustrated in FIG. 18, an RF circuit $\mathbf{612}_n$, an antenna $\mathbf{611}_n$ and a CPU $\mathbf{613}_n$ that are each connected to the RF circuit $\mathbf{612}_n$, and a memory $\mathbf{614}_n$, a second control circuit $\mathbf{616}_n$ and an interface (I/O) circuit $\mathbf{618}_n$ which are each connected to the CPU $\mathbf{613}_n$. An LED $\mathbf{617}_n$ is connected to the I/O circuit $\mathbf{618}_n$, and a sensor $\mathbf{615}_n$ is connected to the sensor control circuit $\mathbf{616}_n$.

Further, memories $\mathbf{614}_1$, $\mathbf{614}_2$, . . . , $\mathbf{614}_n$ of the data carriers $\mathbf{607}_1$, $\mathbf{607}_2$, . . . , $\mathbf{607}_n$ are stored with different items of information, e.g., point information allocated to the respective characters, and character identification codes etc. The game machine 600 described above is designed for such a game that the character with its eye (LED) lit up among the characters $\mathbf{606}_1$, $\mathbf{606}_2$, . . . , $\mathbf{606}_n$, is hit by a hammer 605, and the player gaining the largest sum of points allocated to the beaten characters is the winner.

Then, to begin with, the players arrange the characters $\mathbf{606}_1$, $\mathbf{606}_2$, . . . , $\mathbf{606}_n$ on the game board 601.

A range in which the characters $\mathbf{606}_1$, $\mathbf{606}_2$, . . . , $\mathbf{606}_n$ can be arranged on the game board 601 is set equal to a range in which the data can be transmitted and received between the antenna 602 and each of the characters $\mathbf{606}_1$, $\mathbf{606}_2$, . . . , $\mathbf{606}_n$. The host computer 603 is thereby capable of recognizing only the characters arranged on the game board 601. Namely, it never happens that the host computer 603 recognizes the existence of the character not existing on the game board 601.

When making the preparation for the game in the manner described above, next, the player pushes the start button 604.

Subsequently, the host computer 603 recognizes that the start button 604 is pushed, and transmits through the antenna 602 the radio wave for recognizing the character existing on the game board 601.

Further, the host computer 603 clears a counter for counting, e.g., the number of points of the player.

The radio waves from the antenna 602 are received by antennas $\mathbf{611}_1$, $\mathbf{611}_2$, . . . , $\mathbf{611}_n$ of data carriers $\mathbf{607}_1$, $\mathbf{607}_2$, . . . , $\mathbf{607}_n$ of the characters $\mathbf{606}_1$, $\mathbf{606}_2$, . . . , $\mathbf{606}_n$.

The RF circuits $\mathbf{612}_1$, $\mathbf{612}_2$, . . . , $\mathbf{612}_n$ of the data carriers $\mathbf{607}_1$, $\mathbf{607}_2$, . . . , $\mathbf{607}_n$ drive other circuits by dint of electric power of the radio waves received by the antennas $\mathbf{611}_1$, $\mathbf{611}_2$, . . . , $\mathbf{611}_n$.

CPUs $\mathbf{613}_1$, $\mathbf{613}_2$, . . . , $\mathbf{613}_m$ of the data carrier $\mathbf{607}_1$, $\mathbf{607}_2$, . . . , $\mathbf{607}_n$ transmit identification codes among items of information stored in the multi-value memories $\mathbf{614}_1$, $\mathbf{614}_2$, . . . , $\mathbf{614}_n$ from the antennas $\mathbf{611}_1$, $\mathbf{611}_2$, . . . , $\mathbf{611}_n$.

The antenna 601 receives the identification codes transmitted from the antennas $\mathbf{611}_1$, $\mathbf{611}_2$, . . . , $\mathbf{612}_n$.

The host computer 603 recognizes which character exists on the game board 601 on the basis of the identification code received by the antenna 601, i.e., the identification code indicating the character existing on the game board.

At this time, the host computer 603 recognizes the character existing on the game board 601, and stores the unillustrated multi-value memory with the identification code and point information allocated to the respective characters, which are contained in the radio waves received by the antenna 601.

Next, the host computer 603 selects one character, e.g., the character $\mathbf{606}_n$ at random among the characters existing on the game board 601.

Next, the host computer 603 transmits from the antenna 402 the information indicating the command of lighting up the LED (eye) $\mathbf{617}_n$ of the character $\mathbf{606}_n$ selected.

The radio waves from the antenna 602 are received by the antennas $\mathbf{611}_1$, $\mathbf{611}_2$, . . . , $\mathbf{611}_n$ of the data carriers $\mathbf{607}_1$, $\mathbf{607}_2$, . . . , $\mathbf{607}_n$ of the characters $\mathbf{606}_1$, $\mathbf{606}_2$, . . . , $\mathbf{606}_n$ existing on the game board 601.

The RF circuits $\mathbf{612}_1$, $\mathbf{612}_2$, . . . , $\mathbf{612}_n$ of the data carriers $\mathbf{607}_1$, $\mathbf{607}_2$, . . . , $\mathbf{607}_n$ drive other circuits by dint of electric power of the radio waves received by the antennas $\mathbf{611}_1$, $\mathbf{611}_2$, . . . , $\mathbf{611}_n$.

Each of the CPUs $\mathbf{613}_1$, $\mathbf{613}_2$, . . . , $\mathbf{613}_n$ of the data carriers $\mathbf{607}_1$, $\mathbf{607}_2$, . . . , $\mathbf{607}_n$ thereby judges whether or not the radio wave (information) received by each of the antennas $\mathbf{611}_1$, $\mathbf{611}_2$, . . . , $\mathbf{611}_n$ is transmitted to the self-character, and, if transmitted to the self-character, lights up each of the LEDs $\mathbf{617}_1$, $\mathbf{617}_2$, . . . , $\mathbf{617}_n$ through each of the I/O circuits $\mathbf{618}_1$, $\mathbf{618}_2$, . . . , $\mathbf{618}_n$.

Herein, it is assumed that the character $\mathbf{606}_n$ is selected, and hence the CPU 613, lights up the LED 617, through the I/O circuit 418 in the data carrier $\mathbf{607}_n$ of the character $\mathbf{606}_n$.

At this time, the CPU 613, keeps the LED $\mathbf{617}_n$ lit up during a predetermined period of time.

Accordingly, the eye (LED $\mathbf{617}_n$) of the character $\mathbf{606}_n$ is lit up, and the player hits this character $\mathbf{606}_n$ with the hammer 605.

Herein, the data carrier $\mathbf{607}_n$ of the character $\mathbf{606}_n$ detects whether or not the character $\mathbf{606}_n$ is hit by the hammer 605 under control of the sensor control circuit $\mathbf{616}_n$, and supplies the CPU $\mathbf{613}_n$ with a detected result through the sensor control circuit $\mathbf{616}_n$.

The CPU $\mathbf{613}_n$ judges from the detected result given from the sensor $\mathbf{615}_n$ whether or not the character $\mathbf{606}_n$ is hit by the hammer 605 during a period for which the eye (LED $\mathbf{617}_n$) of the character $\mathbf{606}_n$ is lit up, and transmits a result of the judgment from the antenna $\mathbf{611}_n$. The radio wave (judged result) transmitted from the antenna $\mathbf{611}_n$ is received by the antenna 602, and the host computer 603, if the character $\mathbf{606}_n$ is hit by the hammer 605 during the period for which the eye (LED $\mathbf{617}_n$) of the character $\mathbf{606}_n$ is lit up, makes the above-described counter count up the number of points corresponding to the character $\mathbf{606}_n$ on the basis of the information stored in the multi-value memory in the way explained above in accordance with the radio wave (judged result) received by the antenna 602.

Further, in accordance with the radio wave (judged result) received by the antenna 602, the host computer 603, if the character 606 is not hit by the hammer 605 during the period for which the eye (LED $\mathbf{617}_n$) of the character $\mathbf{606}_n$ is lit up, performs no addition of the number of point. Then, the host computer 603 repeats a predetermined number of times operations such as re-selecting one character at random among the characters $\mathbf{606}_1$, $\mathbf{606}_2$, . . . , $\mathbf{606}_n$ existing on the game board 601 and transmitting from the antenna 602 the information indicating the command of lighting up the LED (eye) of the selected character.

Accordingly, if the character selected at random and having the LED (eye) lit up is hit by the hammer 605 during the period for which the LED (eye) is lit up, the number of points of the player is added.

Then, when the operations given above are repeated the predetermined number of times, the host computer 603 displays a sum of the points of the player on the screen on the unillustrated display unit.

The player is thereby able to recognize the number of player's own points.

As discussed above, in accordance with this embodiment, the data carriers including the sensors and the sensor control circuits are incorporated into the respective characters $\mathbf{606}_1$, $\mathbf{606}_2$, . . . , $\mathbf{606}_n$, thereby detecting whether or not each of the characters $\mathbf{606}_1$, $\mathbf{606}_2$, . . . , $\mathbf{606}_n$ is hit by the hammer 605 except for receiving the radio waves from the host computer 602. With this construction, the whack-a-mole game machine 600 can be provided at a low cost with a simple configuration.

Note that each of the characters $\mathbf{606}_1$, $\mathbf{606}_2$, $\mathbf{606}_n$ may be so constructed as to move around by provided a driving unit such as a battery, etc, in the sixth embodiment discussed above.

Further, for instance, there are prepared a plurality of patterns for lighting up the LEDs of the characters $\mathbf{606}_1$, $\mathbf{606}_2$, . . . , $\mathbf{606}_n$, and may also be set the rule against the mis-touching due to the confusion in the lighting patterns.

The above transmission of information is not limited to the games but may be applied to a variety of information processes.

The data carrier according to the present invention is not confined to only the games but may also be applied to all of applications for executing some sort of processes by identifying the person and the object.

For example, the data carrier can be used for a variety of managements such as a settlement process in a road fee collecting system and a traffic passenger ticket system, an ID management in a building in-and-out management system and a physical distribution service management system such as home delivery services, a history management in a factor manufacturing line management system and a medical sheet management system, and a location management in a parking utilizing management system.

The data carrier according to the present invention involves the use of the multi-value memory having a large capacity for storing the data. Therefore, the data carrier used for specifying, e.g., a person may include all items of data for identifying the individual such as, e.g., not only driver's license data, passport data and a bank account number for a financial institute but also physical features, DNA data, fingerprint data and voice-print data, etc.

Eighth Embodiment

Next, an embodiment in which the non-contact type data carrier is used for an automated traveling control system of a carrier robot will be explained by way of one applied example of the above data carrier with reference to FIG. 19.

Figure 19:
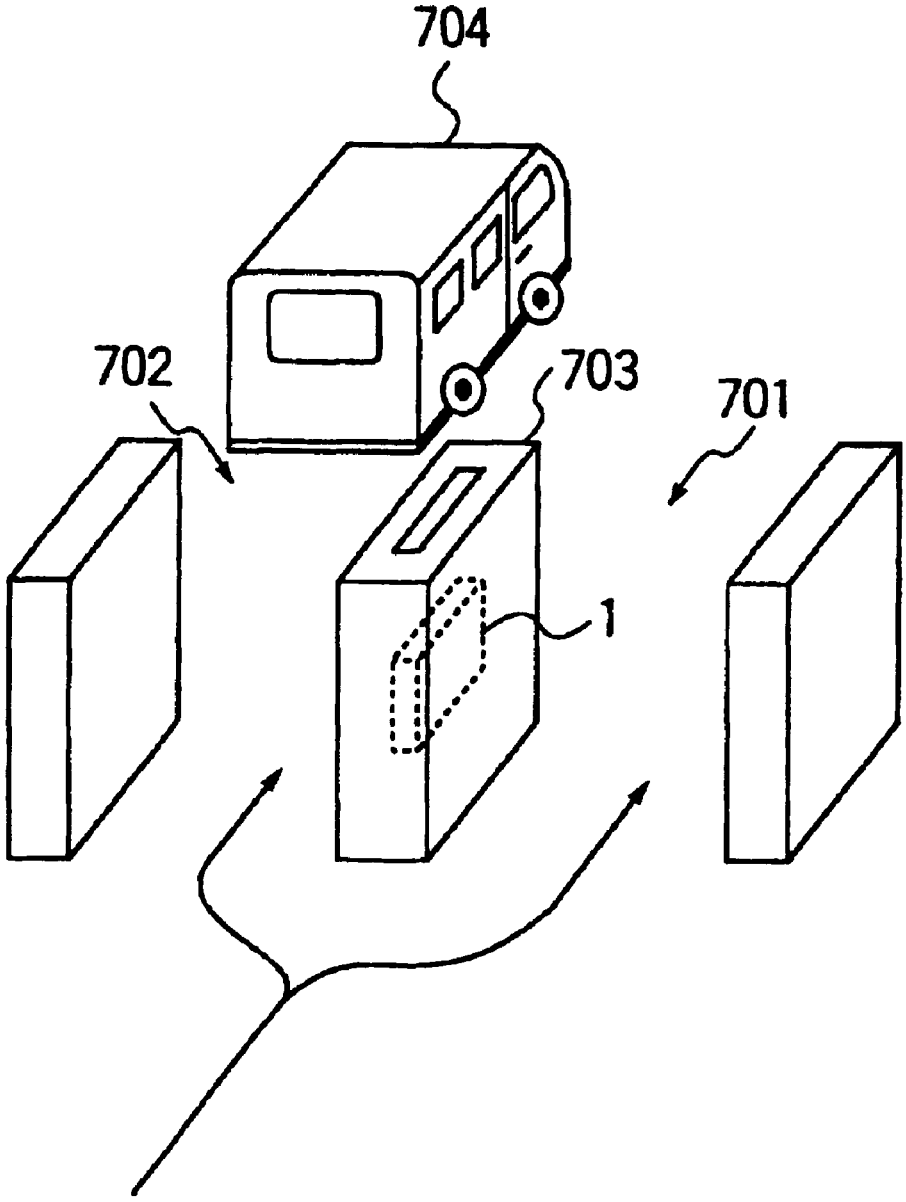
FIG. 19 is a diagram schematically showing a construction in an embodiment in which the non-contact type data carrier is used in an automated traveling control system of a carrier robot.

To be specific, FIG. 19 shows a configuration in which the non-contact type data carrier 1 capable of making the judgment about the surface and the underside as explained in FIG. 2 is set inwardly of a central partition wall 703 for partitioning a first gate 701 and a second gate 702 from each other.

With such a configuration, a carrier robot 704 mounted with an inquiry machine (unillustrated) passes by the first gate 701 or the second gate 702, and, corresponding to this passage, the first or second function incorporated into the non-contact type data carrier 1 responds, whereby it is feasible to automatically implement the predetermined control corresponding to the gate by which the carrier robot 704 mounted with the inquiry machine (unillustrated).

Moreover, in the case of this embodiment, the non-contact type data carrier 1 is simply disposed within the partition wall 703, and therefore a work for connecting the signal line and the power supply line to the partition wall 703 becomes unnecessary. This makes it possible to simply construct the 2-gate automatic traveling control system.

When changing a control content in this automated traveling control system, the non-contact type data carrier 1 disposed inwardly of the partition wall 703 may be simply replaced, or alternatively a program in the non-contact type data carrier 1 may be rewritten. It is therefore feasible to facilitate the work of changing the control content of the automated traveling control system.

Thus, the data carrier according to the present invention can be adopted in place of the conventional bar codes in a field of the physical distribution management as a beginning and so on.

The non-contact type data carrier explained above is applicable to the control of an information processing machine. In this case, the data carrier may be applied to a system comprising a plurality of devices (e.g., a host computer, an interface device, a reader and a printer etc) or to an apparatus comprising one device.

In this case, the function actualized by the data carrier may include a transmission of operating commands to the variety of devices and a supply of program codes of software stored in a ROM etc. Further, the operating commands to the various devices may include a supply of the intra-apparatus or the intra system program codes from a storage medium thereof to the apparatus or to the CPU for controlling the system. The storage medium for storing the program codes may involve the use of, e.g., a floppy disk, a hard disk, an optical disk, a magneto-optical disk, a CD-ROM, a magnetic tape, a non-volatile memory card and a ROM etc.

Further, some embodiments have dealt with the program storage medium. It is, however, a part of the present invention to actualize the function implemented by the respective devices and the computer (the CPU or an MPU) as the control device in the system in other embodiments, and, for actualizing these function, the storage medium for supplying the control device with software program codes for operating the related devices may also constitute a part of the invention.

The storage medium for storing such program codes may involve the use of, e.g., a floppy disk, an exchangeable type hard disk, a magnetic recording medium such as ZIP, jaZ™, an optical recording medium or a magneto-optic recording medium such as a Minidisk™, MO and DVD, a CD-ROM, a magnetic tape, a non-volatile memory card and a ROM cassette, etc.

Furthermore, the program codes are includes in the scope of the present invention, for not only the cases where the above-mentioned embodiments are realized by executing the program codes by a computer, but also the cases the above-mentioned embodiments are realized when the program codes are executed by cooperating an OS under operation or other application software.

Still further, it should be noted that when the supplied program codes have been stored in an extended function board, or in a memory in an extended function unit connected to the CPU, apparatuses and systems where the above-mentioned embodiments are realized by a whole or a part of CPU operation based on instructions of the program codes, are considered to be included in the scope of the present invention.

Structural configuration and data write and data read operation of the multi-value memory will now been explained.

Figure 20:
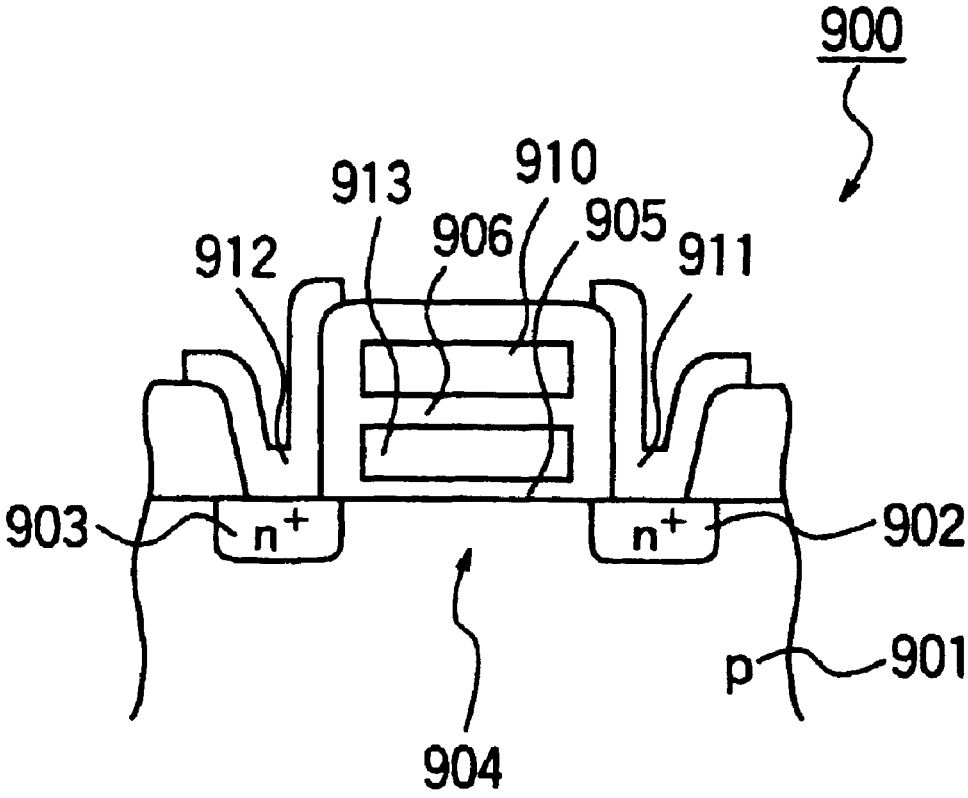
FIG. 20 is a sectional view of an EEPROM cell.

FIG. 20 shows a sectional view of an EEPROM (flash EEPROM) cell of the multi-level memory. The multi-level memory includes a plurality of such flash EEPROM cells.

As shown in FIG. 20, the memory cell 900 has the following structure:

A drain region 902 and a source region 903 with n type impurity diffused are formed in the surface part of a p-type substrate 901. The region 904 between the source and drain is used as a channel region. A tunnel insulating film 905 of $SiO_2$ having a thickness of approx. 10 nm is formed on the channel region 904, and a stacked structure having a floating gate 913 of a low resistance polysilicon, an inter-layer insulating film 906 and a control gate is formed on the channel region 904. A bit line 911 is connected to the drain 912 and a source line 912 is connected to the source 903.

An operation for writing four-value data "00"-"11" in an objective memory cell will be described.

In the case where a data "11" is written, a selected bit line 911 is grounded, the source line 912 is opened and a pulse voltage having 10 through 15V is applied to a selected control gate (word line). As a result, a voltage is induced in the floating gate 913 of the objective cell, then charges are injected in the polysilicon by well known Fowler-Nordheim tunneling mechanism in response to voltage difference between the floating gate 913 and the drain 902. By theses operation, a threshold value of the objective cell will increase approx. 7V, and such status is defined as "11" status.

During the operation, by applying approx. 3 V for bit lines of other cells, since the Fowler-Nordheim tunneling of electrons will not occur in the other cell, no data will be written.

Similarly, in the case where a data "10" is written in the objective cell, the selected bit line 911 is grounded, the source line 912 is opened and a pulse voltage having approx. 1V is applied to a selected control gate (word line). As a result, a threshold value of the objective cell will increase approx. 5V, and such status is defined as "10" status.

Similarly, in the case where a data "01" is written in the objective cell, the selected bit line 911 is grounded, the source line 912 is opened and a pulse voltage having approx. 2V is applied to a selected control gate (word line). As a result, a threshold value of the objective cell will increase approx. 3V, and such status is defined as "01" status.

Similarly, in the case where a data "00" is written in the objective cell, the selected bit line 911 is grounded, the source line 912 is opened and a pulse voltage having approx. 3V is applied to a selected control gate (word line). As a result, a threshold value of the objective cell will increase approx. 1V, and such status is defined as "01" status in which almost there has been no change from the initial threshold value (erase level).

Figure 21:
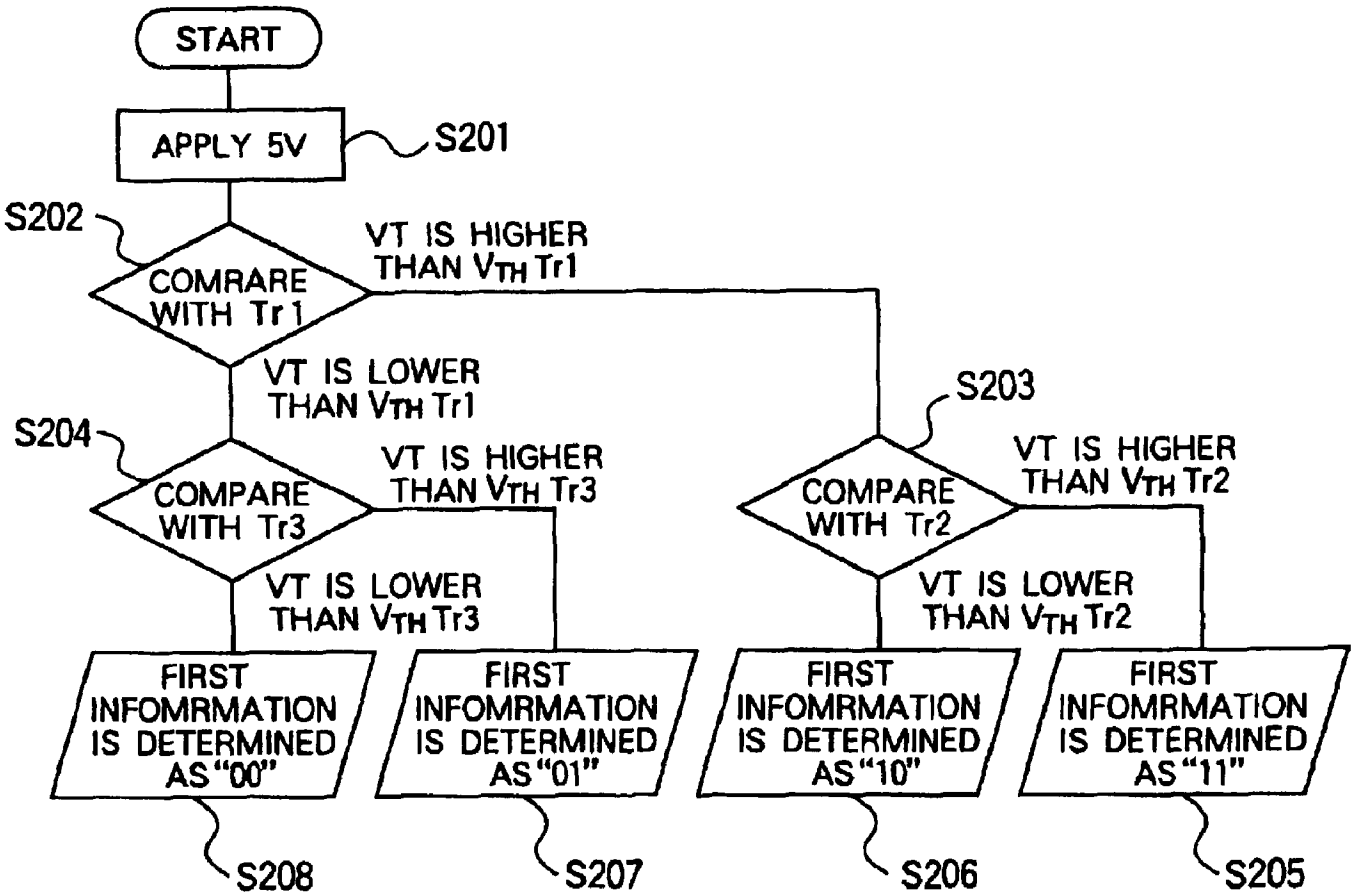
FIG. 21 is a flowchart showing two-bit (four-value) data determination process.
Figure 22:
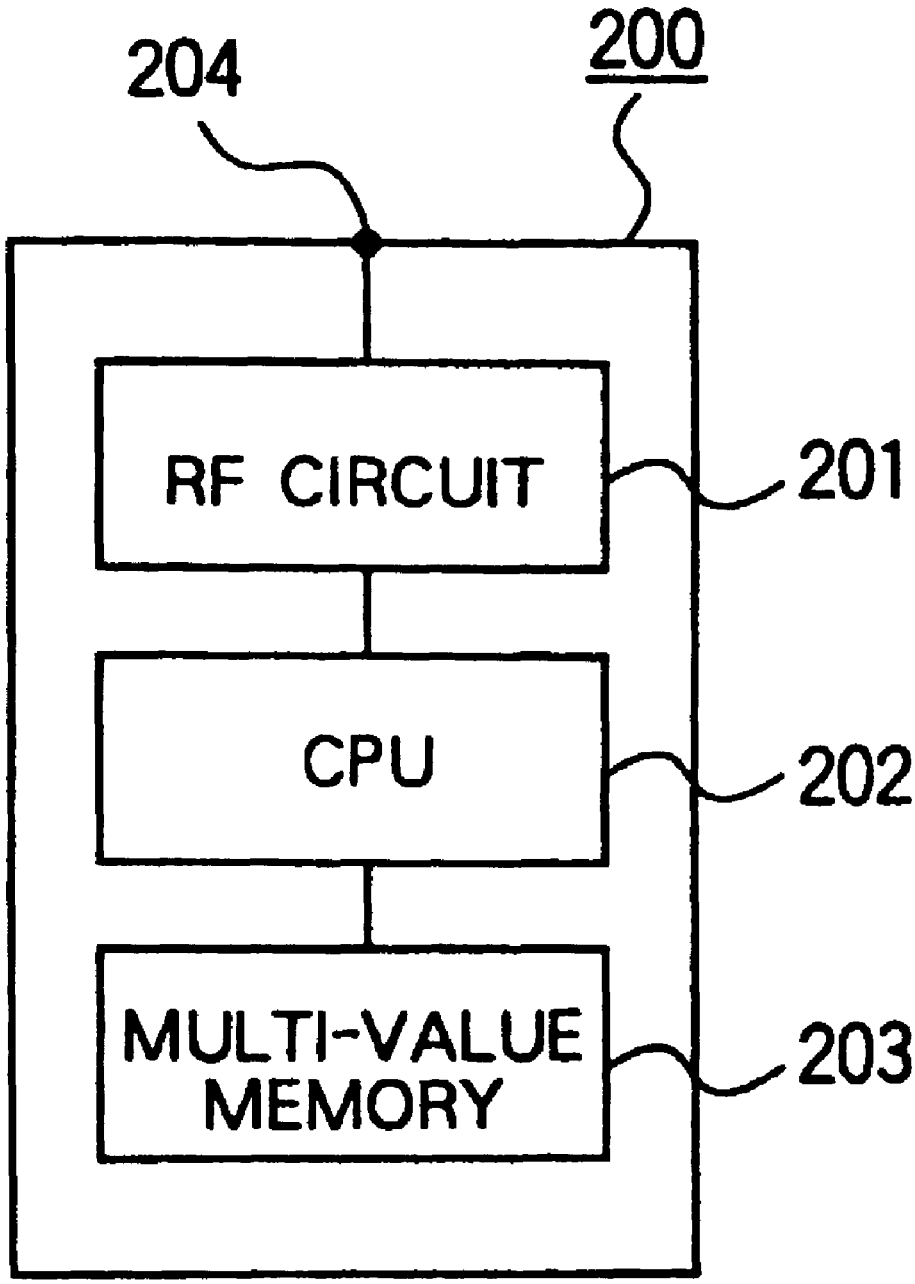
FIG. 22 is a block diagram showing a second embodiment of the data carrier according to the present invention.

Next, data reading operations from EEPROM cells which have stored data will be explained with reference to FIG. 21.

First, it is judged whether the high-order bit of the stored information is "0" or "1". For this purpose, a reference voltage of approx. 5V is applied across the drain/source and control gate of the selected memory cell (step S201), drain current is detected by a sense amplifier, and further it is determined whether a threshold voltage $V_T$ or the threshold voltage of a reference transistor Tr1 is higher (step S202).

If the threshold voltage $V_T$ is higher than the threshold voltage of the reference transistor Tr1, the high-order bit is determined to be "1", and to the contrary, if the threshold voltage $V_T$ is lower than the threshold voltage of the reference transistor Tr1, the high-order bit is determined to be "0".

In the case where the threshold voltage $V_T$ is higher than the threshold voltage of the reference transistor Tr1, further determination whether the threshold voltage $V_T$ or a threshold voltage of a second reference transistor Tr2 is higher similarly as steps S201 and S202 (step S203).

By this comparison, if the threshold voltage $V_T$ is higher than the threshold voltage of the reference transistor Tr2, the information stored in the selected memory cell is determined as "11" (step S205), and on the contrary, if the threshold voltage $V_T$ is lower than the threshold voltage of the reference transistor Tr2, the stored information is determined as "10" (step S206). These determined information is read out from the memory cell.

Further, if the threshold voltage $V_T$ is detected to be lower than the threshold voltage of the reference transistor Tr2 (that means the higher order bit is "0"), another comparison between the threshold voltage $V_T$ and a threshold voltage of a third reference transistor Tr3.

By this comparison, if the threshold voltage $V_T$ is higher than the threshold voltage of the reference transistor Tr3, the information stored in the selected memory cell is determined as "01" (step S207), and on the contrary, if the threshold voltage $V_T$ is lower than the threshold voltage of the reference transistor Tr3, the stored information is determined as "00" (step S208). And these determined information is read out from the memory cell.

When the EEPROM where above-described writing and reading are performed is used as a multi-value memory, writing data therein and reading data therefrom are performed as follows:

For example, in a non-contact type data carrier shown in FIG. 8, if data rewriting unit is provided in the CPU, it is possible to realize data rewriting in the multi-value memory 203 by receiving rewrite instruction signal by the antenna 204 and the CPU 202 and by transmitting the rewrite instruction signal to the multi-value memory 203.

Furthermore, it is possible to provide in a data carrier terminals for rewriting the stored contents by external unit through the terminals.

Such variation is suited for the contact type data carrier.

For example, in the data carrier shown in FIG. 8, if the antenna 204 of the non-contact type data carrier 200 is replaced by a contact terminal part 204', information transmitting/receiving between the contact type data carrier and an external unit can be performed by contacting the contact part to a part of the external unit.

More specifically, similar to the above-mentioned non-contact type data carrier, if data rewriting function is provided in the CPU 202, it is possible to realize data rewriting in the multi-value memory 203 by receiving rewrite instruction signal through the contact terminal part 204' and by transmitting the rewrite instruction signal to the multi-value memory 203.

In the case where data is read out form the memory cell of the multi-value memory, data reading function for reading data from the multi-value memory 203 is provided in the CPU 202 of the non-contact type data carrier 200, it is possible to realize data reading from the multi-value memory 203 by supplying reading instruction signal received through the antenna 204.

In the contact type data carrier, if data reading function form the multi-value memory 203 is provided in the CPU 202, it is possible to realize data reading from the multi-value memory 203 by supplying reading instruction signal received through the contact terminal part 204' from the external unit.

As described in the above embodiments in which the multi-value memory is constructed by EEPROM, multi-value data writing and data reading can be executed in either the non-contact type data carrier or the contact type data carrier.

Furthermore, the above-mentioned multi-value memory can store 2-bit or more binary data. In this case, if the storing state is expressed by n bit, that is, $2^n$ value (n is an integer of 2 or more), 2n kind of reference voltages (threshold voltages) should be prepared. For example, if the storing state is 2 bit form (four values), storing states are determined by preparing four threshold voltages for storing states of "00", "01", "10" and "11", and by performing predetermined determination operation.

According to such multi-value EEPROM, since storing density of a memory cell will be remarkably increased, further integration and miniaturization are achieved.

Moreover, the stored information is not limited to binary data, but for example three-bit data, i.e. such as data composed of "0", "1" and "2", storing states can take three values of "0", "1" and "2", or nine values of "00", "01", "02", "10", "11", "12", "20", "21" and "22" can also be used. For the former three values, three threshold values are employed, and the latter three values, nine threshold values are employed.

It is noted that the multi-value memory is not limited to the EEPROM, but FRAM (Ferro-electric Random Access Memory), for example, which can store multi-value data by providing a plurality of capacitors disclosed for example in Japanese Patent Laid-open Publications 8-180673 (1996), 7-122661 (1995), 5-28773 (1993), 5-28774 (1993) and 8-124378 (1996), etc. can be employed.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An automated traveling control system for executing a process corresponding to a kind of a carrier object traveling by a gate, comprising: first and second gates; a carrier object traveling by said first and second gates and mounted with an inquiry machine for transmitting a radio wave containing information; a partition wall for partitioning said first and second gate from each other; and a non-contact type data carrier embedded into said partition wall and including a control unit for detecting which side of said first or second gate by receiving the incoming radio wave transmitted from said inquiry machine and executing an opening/closing process of said gate at least on the relevant side depending on any one of said first and second gate sides, and the control unit comprising a surface/underside judging circuit for judging which side of the non-contact type data carrier receives the incoming radio wave.

* * * * *